US007837282B2

(12) United States Patent
Youngs et al.

(10) Patent No.: US 7,837,282 B2
(45) Date of Patent: Nov. 23, 2010

(54) MODULAR STORAGE SYSTEM

(75) Inventors: Bradley D. Youngs, Byron Center, MI (US); Randall P. Nelsen, Alto, MI (US); Timothy J. Wiersma, Grandville, MI (US); Kevin J. Longhurst, Hastings, MI (US); Keith L. Buffinga, Shelbyville, MI (US); William A. Korreck, Grand Rapids, MI (US); Michael A. Jourden, Grand Rapids, MI (US); Niels Joachim Eilmus, Kentwood, MI (US); Michael W. Welsh, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 1235 days.

(21) Appl. No.: 11/095,260

(22) Filed: Mar. 31, 2005

(65) Prior Publication Data

US 2005/0194871 A1 Sep. 8, 2005

Related U.S. Application Data

(62) Division of application No. 10/095,980, filed on Mar. 12, 2002, now Pat. No. 6,942,306.

(51) Int. Cl.
*A47B 63/00* (2006.01)

(52) U.S. Cl. ..... 312/351

(58) Field of Classification Search ..... 312/257.1, 312/264, 350, 351, 294, 304; 108/109; 248/220.31, 248/250, 301

See application file for complete search history.

(56) References Cited

U.S. PATENT DOCUMENTS 678,125 A * 7/1901 Paulle ..... 248/243
754,814 A * 3/1904 Schriefer ..... 312/107
774,136 A 11/1904 Forbes
850,210 A 4/1907 Cady
1,092,564 A 4/1914 Deming
1,352,002 A 9/1920 Jones
1,393,012 A * 10/1921 Dilg ..... 248/243
1,523,653 A 1/1925 Larson et al.
1,545,016 A * 7/1925 Sessions ..... 384/23
1,735,375 A 11/1929 Card et al.
1,805,989 A 5/1931 Levene
1,994,044 A 3/1935 Michelet
2,005,593 A 6/1935 Onions et al.
2,346,430 A 4/1944 Hauser
2,359,109 A * 9/1944 Hormes ..... 108/96

(Continued)

*Primary Examiner*—James O Hansen
(74) *Attorney, Agent, or Firm*—Price, Heneveld, Cooper, DeWitt & Litton, LLP

(57) ABSTRACT

A cabinet includes side panels, a back panel, and a top panel that frictionally-attach together with non-intrusive integrally-formed connectors. The illustrated base is screw-attached, and includes openings for routing wiring within the cabinet. Brackets are adapted to support shelves in the cabinet in either a flush or inset condition, and at different heights based on which cabinet slots they engage and based on their orientation in those slots. A light-transmitting top panel and top shelf can be used to provide improved light within the cabinet. Hinge brackets on the cabinet support either a thick door with internal storage space, a proud door or an inset door. Drawers supported in the cabinet include a lock within the drawer's header for operating a vertical cabinet lock rod.

7 Claims, 30 Drawing Sheets

U.S. PATENT DOCUMENTS 2,528,807 A 11/1950 Whitney
2,570,731 A * 10/1951 Susnow ..... 248/247
2,793,927 A 5/1957 Reitzel
3,078,133 A 2/1963 Schauer
3,110,536 A 11/1963 Costantini et al.
3,341,270 A 9/1967 Sohl
3,497,280 A 2/1970 Olree et al.
3,572,874 A 3/1971 Hassel
3,589,783 A 6/1971 Studinski et al.
3,602,567 A 8/1971 Schnell et al.
3,764,190 A 10/1973 Anderson
3,767,280 A 10/1973 McLaughlin
3,776,007 A 12/1973 Himsl
3,822,925 A 7/1974 Osroff
3,846,002 A 11/1974 Floetotto
3,883,200 A 5/1975 Latham
3,976,343 A 8/1976 Breckner et al.
4,077,686 A 3/1978 Bukaitz
4,123,130 A 10/1978 Locke
4,232,920 A 11/1980 Bukaitz
4,265,500 A 5/1981 Berton et al.
4,280,686 A * 7/1981 Wack ..... 256/65.07
4,288,132 A 9/1981 Znamirowski et al.
4,295,693 A 10/1981 Viklund
4,296,982 A 10/1981 Kullander
4,344,660 A 8/1982 Molnar et al.
4,466,676 A 8/1984 Nilsson
4,480,744 A 11/1984 Blackmon
4,491,375 A 1/1985 Ugalde
4,674,806 A 6/1987 Kroon et al.
4,691,644 A 9/1987 Frydman
4,705,326 A 11/1987 Craig
4,725,107 A 2/1988 Appleton
4,925,257 A 5/1990 Frederiksen et al.
5,102,210 A 4/1992 Beals
5,127,340 A * 7/1992 Maro et al. ..... 108/107
5,147,122 A 9/1992 Short
5,214,836 A 6/1993 Beals
5,221,131 A 6/1993 Lesperance et al.
5,251,974 A 10/1993 Beals
5,349,909 A * 9/1994 Smit et al. ..... 108/107
5,359,944 A 11/1994 Steinbeck
5,385,039 A 1/1995 Feldpausch et al.
5,403,109 A 4/1995 Johnson et al.
5,456,531 A 10/1995 Beals
5,478,145 A * 12/1995 Kamachi ..... 312/263
5,558,418 A 9/1996 Lambright et al.
D377,277 S 1/1997 Jacobs et al.
5,626,404 A 5/1997 Kelley et al.
5,762,213 A 6/1998 Heneveld, Sr.
5,803,562 A 9/1998 Jacobs et al.
5,820,238 A 10/1998 Lambright
5,893,616 A 4/1999 MacDonald et al.
D409,856 S 5/1999 Rice, Jr.
5,944,398 A 8/1999 Wu
5,946,953 A 9/1999 Feldpausch
5,975,659 A 11/1999 Yang et al.
6,007,170 A 12/1999 Liebertz et al.
6,033,046 A 3/2000 Lambright
6,065,724 A * 5/2000 Arslan et al. ..... 248/248
6,082,839 A 7/2000 Chiku
D430,373 S 8/2000 Montague
6,099,096 A 8/2000 Lambright
6,234,592 B1 5/2001 Liu et al.
6,238,032 B1 5/2001 Cooper et al.
6,283,565 B1 9/2001 Kohler et al.
6,497,462 B2 12/2002 Jackson

* cited by examiner

MODULAR STORAGE SYSTEM

CROSS-REFERENCE TO RELATED APPLICATION

This application is a divisional of U.S. patent application Ser. No. 10/095,980, filed Mar. 12, 2002 now U.S. Pat. No. 6,942,306, entitled MODULAR STORAGE SYSTEM, the entire disclosure of which is incorporated herein by reference.

BACKGROUND

The present invention relates to modular storage units, such as cabinets with drawers and/or shelves, and more particularly relates to a modular storage unit having top, side, and back panels that frictionally attach with the use of integrally-formed interfitting flanges that are secure but non-intrusive and releasable. Several concepts are integrated into the storage units to improve the ability to assemble the units, to provide rearrangeability of shelves without the need for separate shelf brackets, to reduce cost, and to reduce the number of components, all without reducing the ability to provide a customized cabinet adapted to meet specialized needs.

In-process inventory is expensive to keep on-hand and to keep track of. Further, it adds complexity to the manufacturing process and often adds to manual labor. For example, each screw takes time to orient, drill through (or to align predrilled holes), and threadably insert in place. Further, alignment of edges on adjacent panels can be a problem.

It is desirable to provide panels that include integrally formed connectors that are adapted to securely interlock as a way of minimizing the need for separate fasteners. However, such connectors must accurately align interconnected panels as well as hold the panels together. It is also desirable to make the connectors non-intrusive and releasable so that adjacent panels can be attached without concern for corrosion problems, and can be detached and replaced.

It is desirable to adjustably support shelves in different locations and in different orientations in cabinets at the same time, it is desirable to minimize the number of different holes and shelf brackets in order to minimize the number of parts and die-features required. Further, it is desirable to provide additional lighting within cabinets without adding expensive wiring and light fixtures.

Accordingly, a cabinet system is desired solving the aforementioned problems and having the aforementioned advantages.

SUMMARY OF THE PRESENT INVENTION

In one aspect of the present invention, a storage unit includes a pair of side panels, a cover panel, a base panel, and a back panel combining to form an enclosure. The present invention includes a first interface for coupling each side panel to the back panel, and a second interface for coupling each side panel to one of the cover panel and the base panel. One of the first and second interfaces includes a channel and a mating wedge shaped to matingly engage and interlock into the channel. The other of the first and second interfaces includes an apertured flange and a mating hook shaped to matingly engage and interlock with the apertured flange in a direction parallel a length of the apertured flange.

In another aspect of the present invention, a storage unit includes a pair of side panels, a cover panel, a base panel, and a back panel combining to form an enclosure. The invention comprises an improvement where one of the panels has a first edge, a first flange extending longitudinally along the first edge, and a first reversely-bent flange extending at an acute angle from the first flange to define a channel with the first flange, the reversely-bent flange including a ridge that extends parallel to the first flange but that is spaced from the first flange. Another of the panels includes a second edge, a second flange extending longitudinally along the second edge, and a second reversely-bent flange extending from the second flange to define a wedge with the second flange. The second flange and the second reversely-bent flange are shaped to fit tightly into the channel with the second flange lying against the first flange and also with the second reversely-bent flange lying against the first reversely-bent flange and also with the second edge aligned with and extending parallel the first edge. The second reversely-bent flange includes a resilient end that wedgingly engages the ridge when the wedge is pressed into the channel to securely retain the one panel to the another panel in an edge-aligned condition.

In another aspect of the present invention, a cabinet includes side panels with inner surfaces defining an enclosure, the inner surfaces each including vertical rows of apertures defining a unitary vertical spacing, and a shelf. A plurality of brackets are shaped to selectively engage the apertures to support the shelf on the side panels. The brackets include first and second ends, the first end being shaped to engage a selected one of the apertures with the second end positioned to support the shelf at a first height, and the second end being shaped to engage the selected one of the apertures with the first end positioned to support the shelf at a second height different than the first height. By this arrangement, the shelf can be selectively supported at different heights from the same selected apertures while using the same brackets.

In another aspect of the present invention, a cabinet includes side panels with inner surfaces defining an enclosure. The panel includes front edges defining an opening into the enclosure, and apertures in the inner surfaces. A plurality of brackets are shaped to selectively engage the apertures to support a shelf on the side panels in the enclosure. The brackets include a shelf-locating feature, and the shelf includes spaced-apart first and second mating features configured to separately engage the shelf-locating feature to locate the shelf in a flush position and an inset position, respectively. The shelf has a shelf front edge that is located forwardly when in the flush position and rearward when in the inset position.

In another aspect of the present invention, a cabinet assembly for storing office materials and personal effects includes a cabinet having panels defining a cabinet storage space and front edges defining a first access opening to the cabinet storage space. A cabinet shelf is located entirely within the cabinet storage space. A storage door is pivoted to the cabinet and shaped to selectively close the access opening. The storage door includes side sections defining a door storage space and defining a second access opening to the door storage space. The door includes shelves defining storage compartments within the door storage space sufficient in size and shape to hold office articles and personal articles having thickness and weight. The door has a castor adapted to support a free edge of the door on a floor surface to prevent forward tipping of the cabinet when the door is in an open position and when the storage compartments are loaded. The door storage space is additive to the cabinet storage space when the door is closed and characteristically does not intrude into the cabinet storage space. By this arrangement, when the door is in the open position, the cabinet storage space and door storage space can be individually and easily accessed without having to reach into the other of the cabinet storage space and door storage space, and further a rear of the cabinet storage space and door storage space can be individually reached without having to reach a distance equal to a total depth of the cabinet and door storage spaces.

In yet another aspect of the present invention, a cabinet assembly for storing office materials and personal effects includes a cabinet having a plurality of panels defining a cabinet storage space, including a top panel. A plurality of shelves are located within the cabinet storage space. The plurality of panels include a top panel and the plurality of shelves include a top shelf. The top panel and the top shelf are made at least in part from light-transmitting material so that ambient light travels through the top panel and through the top shelf to illuminate one of the plurality of shelves below the top shelf.

In still another aspect of the present invention, a cabinet assembly includes a cabinet with side panels. A lock bar is operably attached to one of the side panels for movement between a drawer-released position and a drawer-locked position. A drawer is provided including a header, and a horizontally-extending lock rod is supported in the header for rotation about a horizontal axis. The lock rod includes a first offset section within the header and a second offset section. The second offset section is movable between an engaged position that moves the lock bar to the drawer locked position and a disengaged position that moves the lock bar to the drawer released position. A lock is supported in the header for actuating the lock rod. The lock includes a lock tumbler, a cam, and a return-biasing member. The lock tumbler is rotatable to move the cam into engagement with the first offset section to in turn rotate the lock rod to the engaged position, and further the lock tumbler is reversely rotatable to reverse the cam and let the return biasing member rotate the lock rod to the disengaged position.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
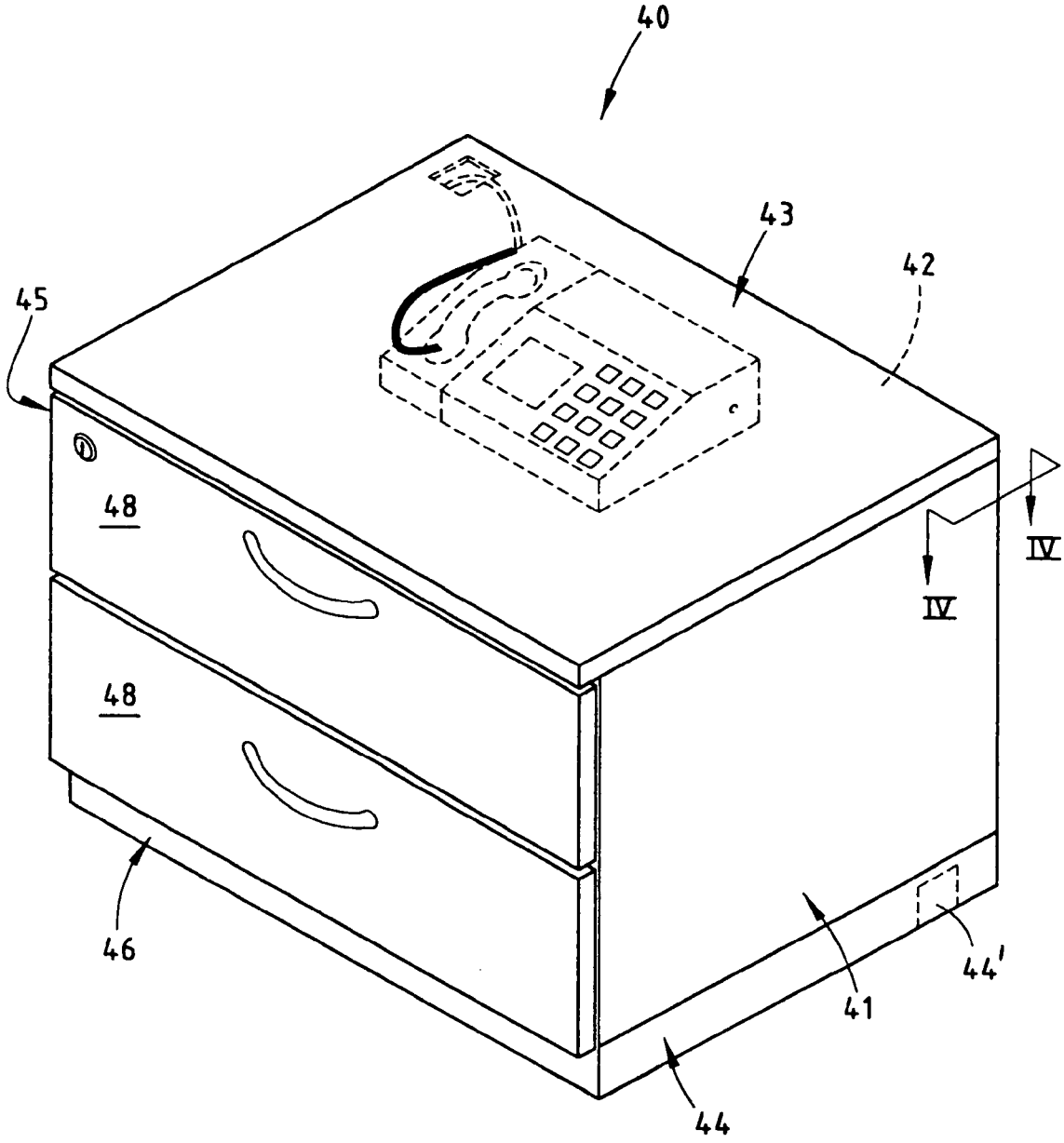
FIGS. 1-2 are a perspective view and an exploded perspective view showing a two-drawer cabinet embodying the present invention.
Figure 2:
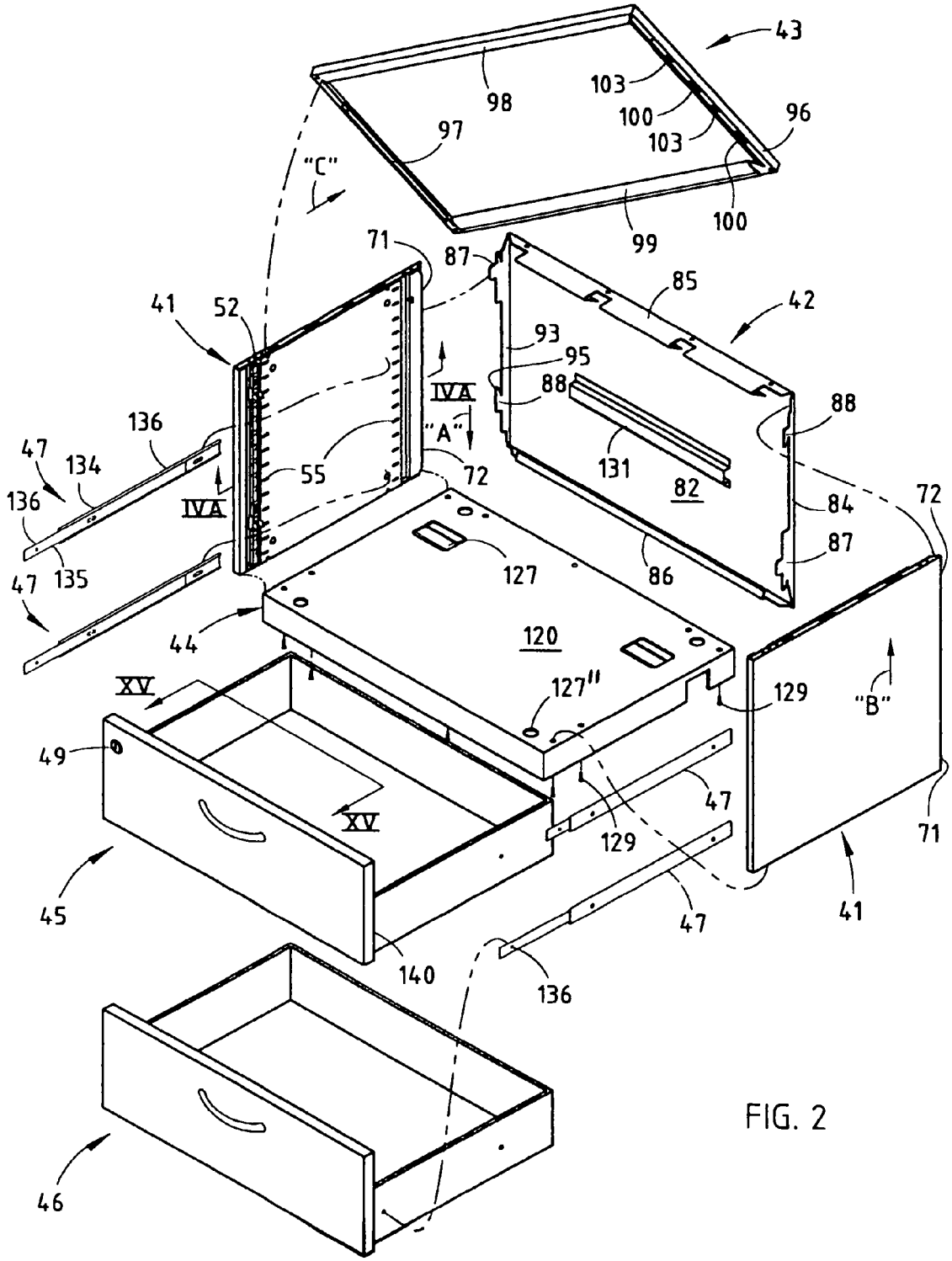
Figure 12A:
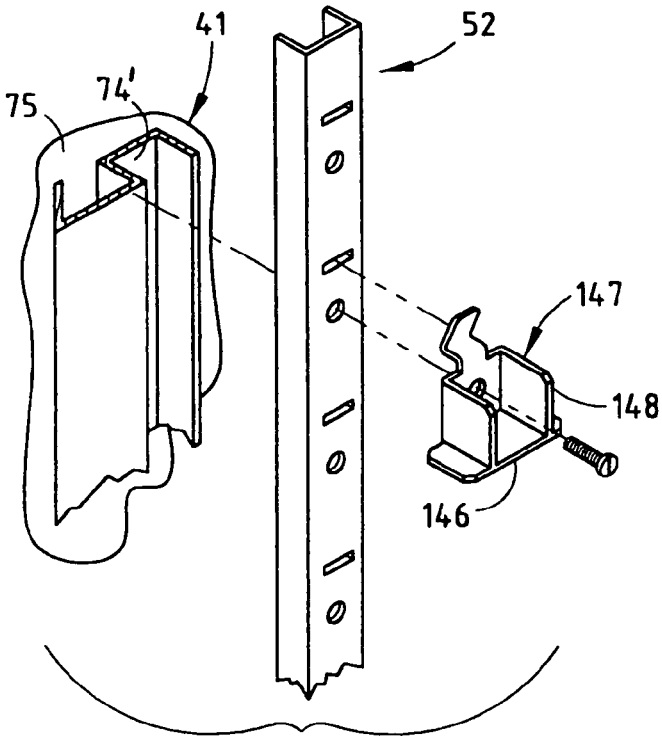
FIG. 12A is an exploded view of FIG. 12.
Figure 13:
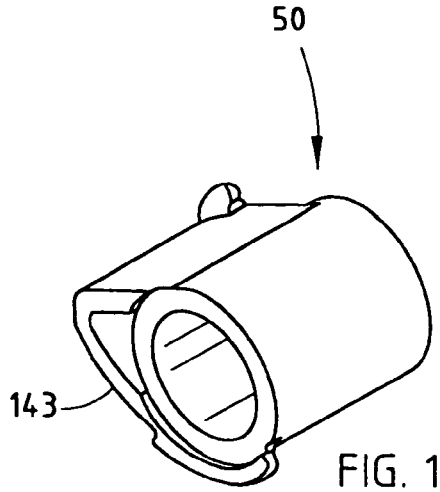
FIG. 13 is a perspective view of a locking cam, as shown in FIG. 14.
Figure 14:
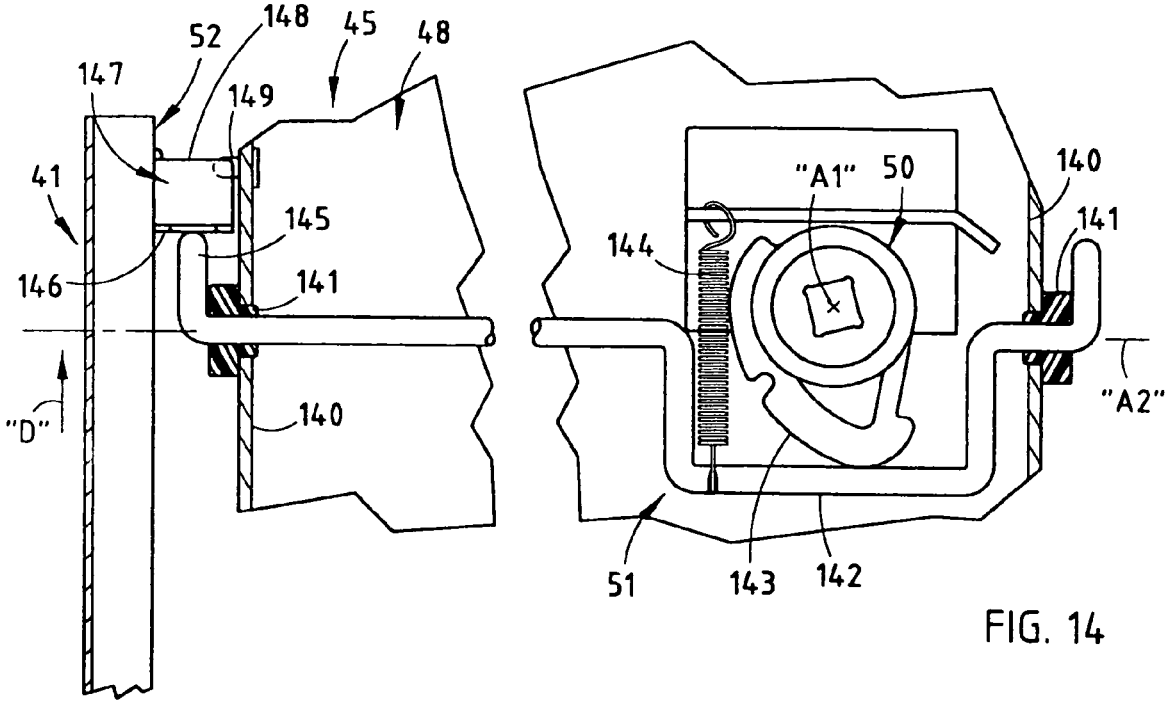
FIGS. 14-15 are views taken in a direction "A" in FIG. 2 of the inside of the drawer header, with the inside skin of the drawer header removed to expose the locking system, FIG. 14 showing a locked position, and FIG. 15 showing an unlocked position.
Figure 18:
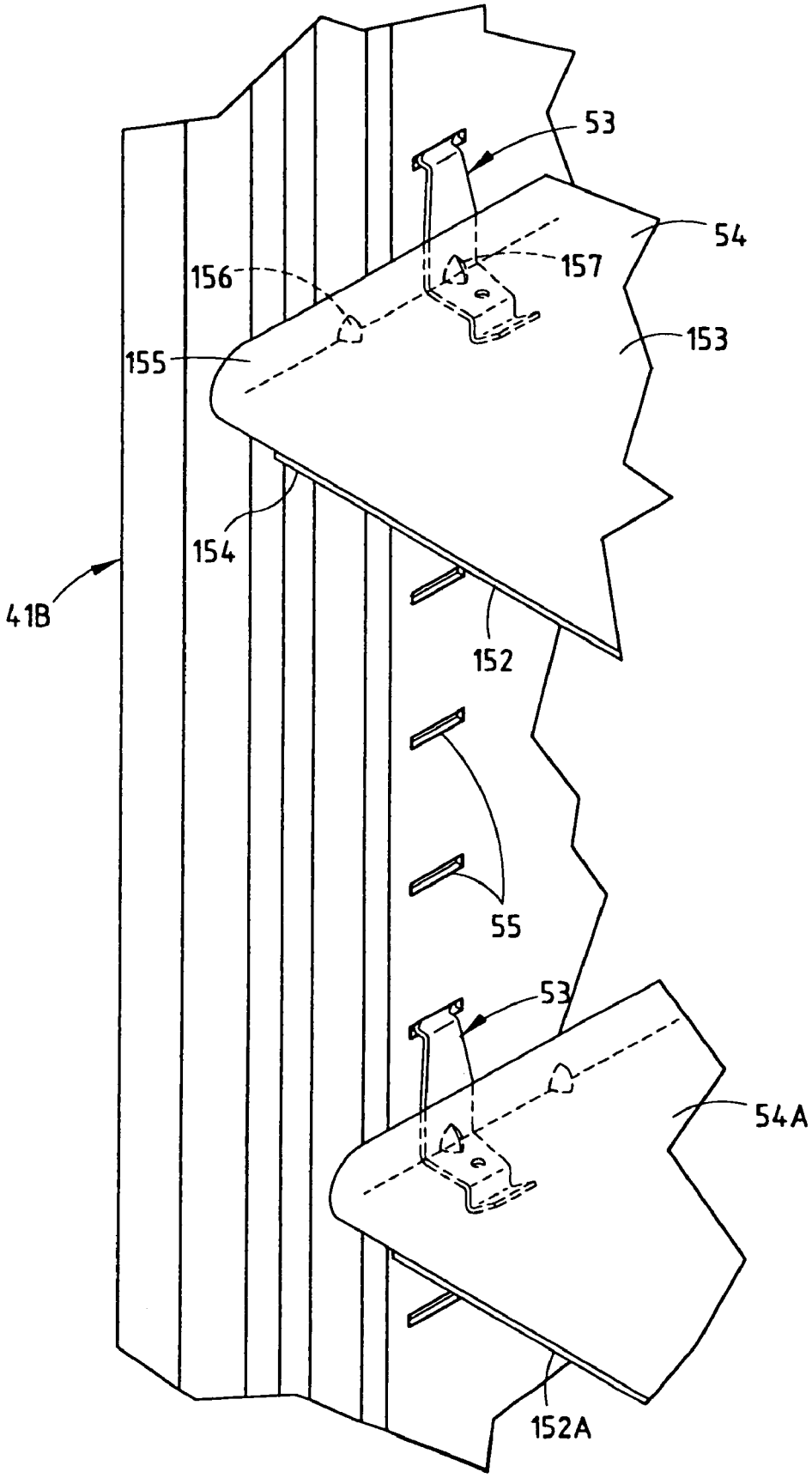
FIG. 18 is a fragmentary perspective view of the cabinet and two identical shelf brackets and shelves, the top shelf being in a forward flush position and the bottom shelf being in a rearward inset position.
Figure 19:
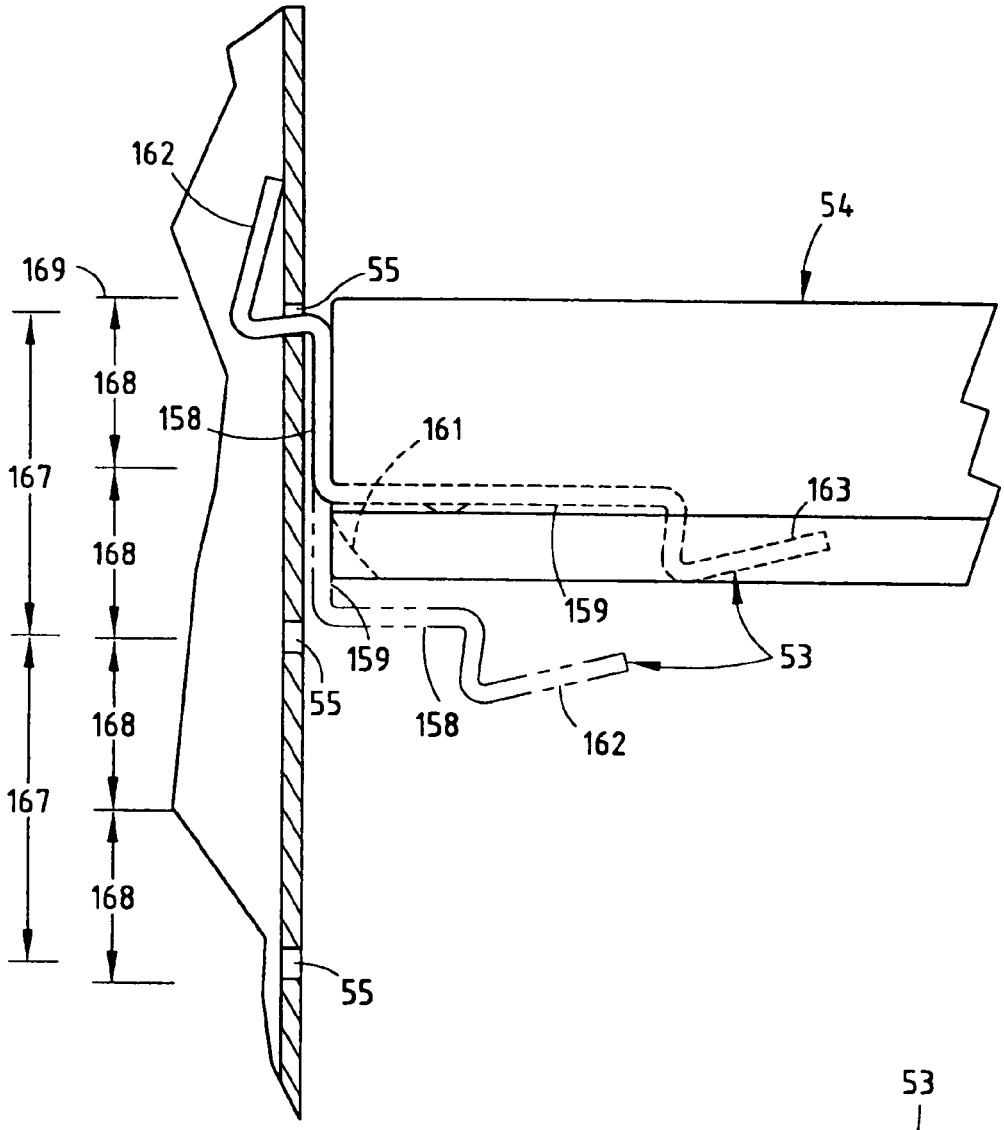
FIG. 19 is a front fragmentary perspective view of the cabinet and the shelf bracket of FIG. 18, the solid lines showing a first position of the shelf bracket in a cabinet slot and the dashed lines showing a second position, the first and second positions holding the shelf at different heights, such that two shelf positions are possible from each slot in the cabinet.
Figure 27:
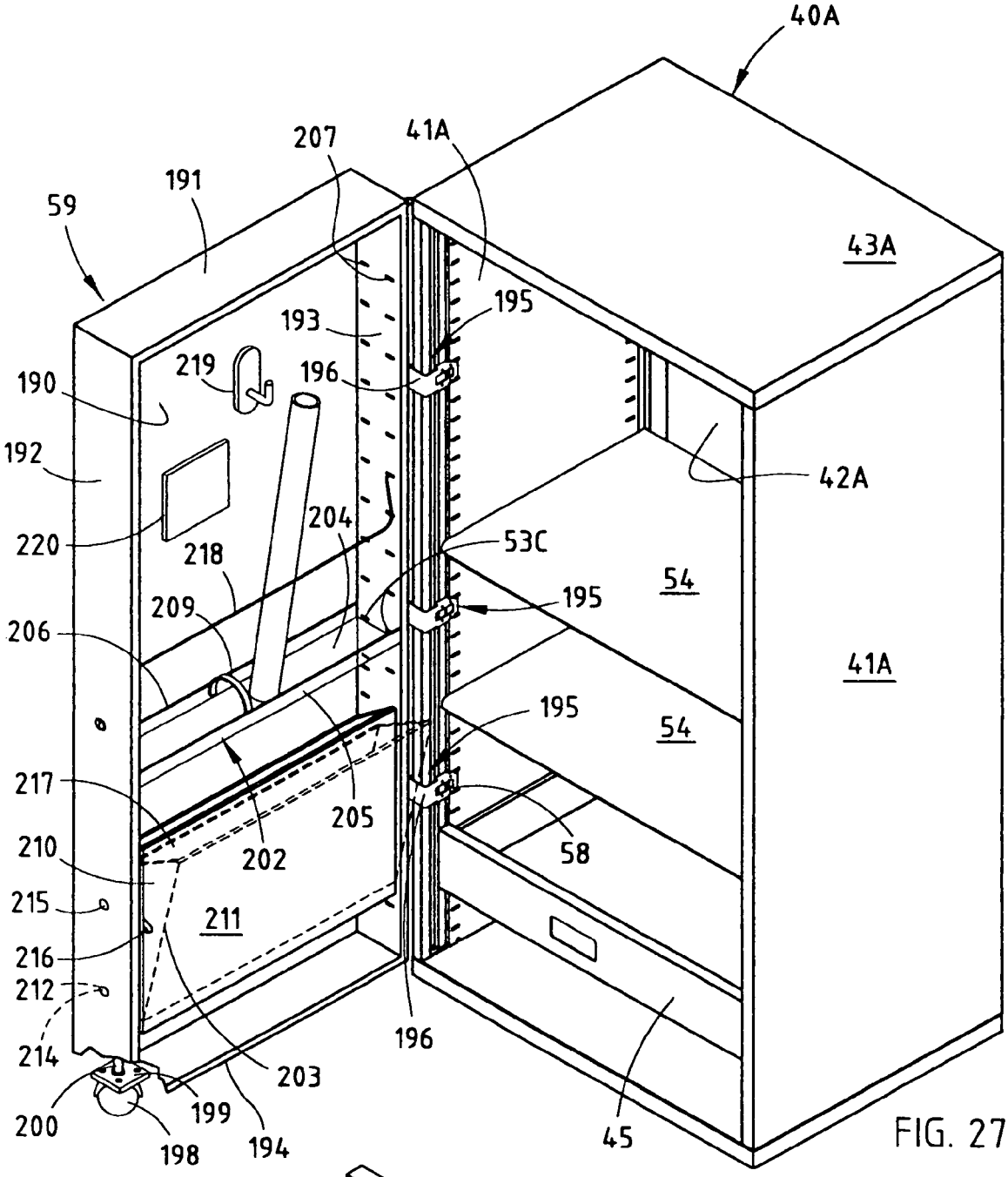
FIG. 27 is a perspective view of the cabinet in FIG. 26, the door being in an open position.
Figure 27A:
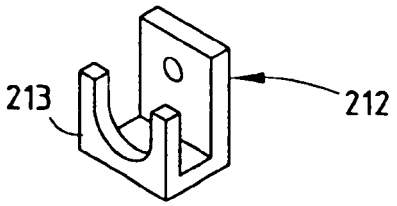
FIG. 27A is a perspective view of a bin-supporting pivot bracket used in FIG. 27.
Figure 28:
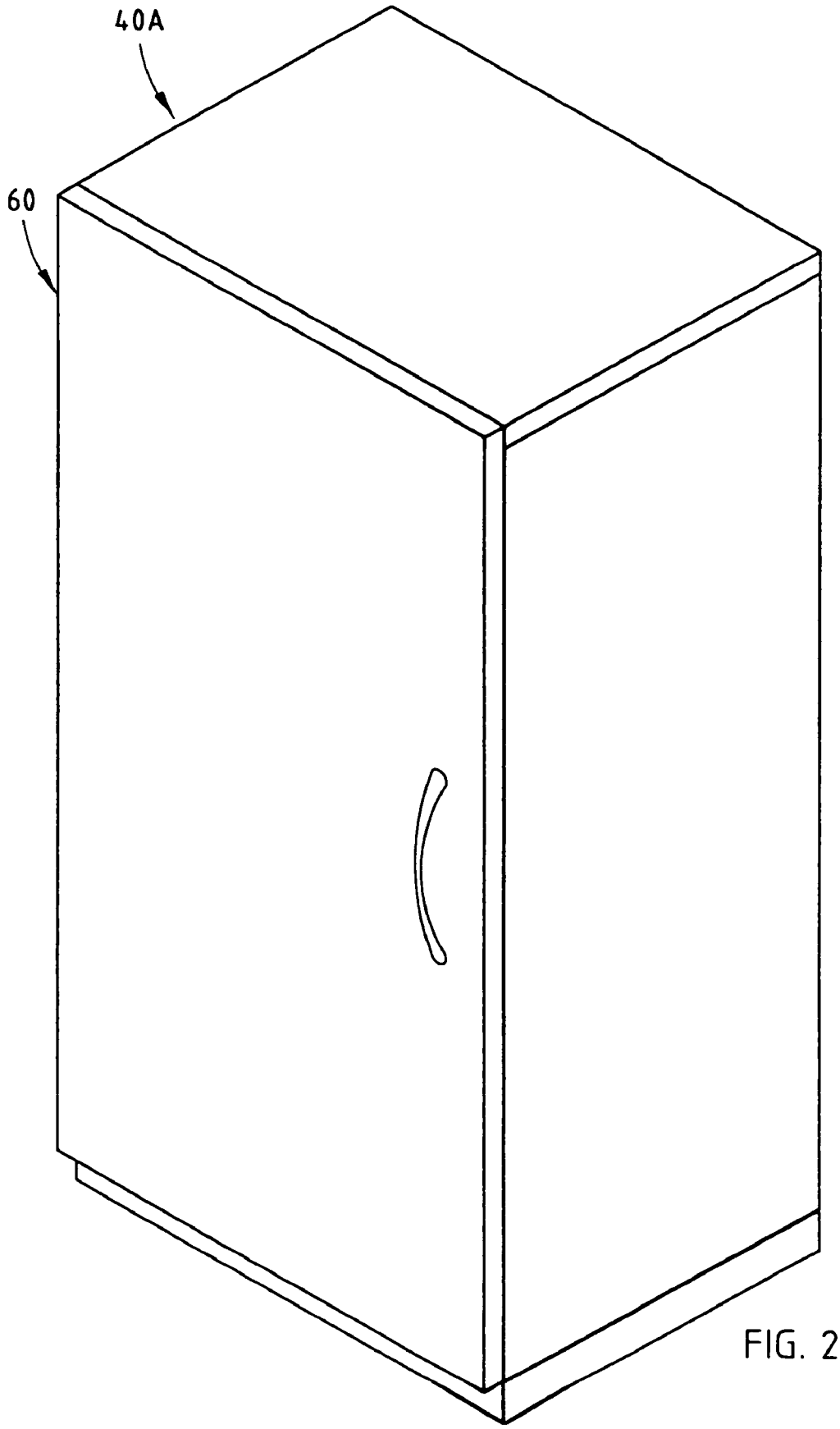
FIGS. 28-29 are perspective views of a cabinet similar to FIG. 26, but having a thin door positioned in a proud or "overlap" position, the door being closed in FIG. 28 and open in FIG. 29.
Figure 29:
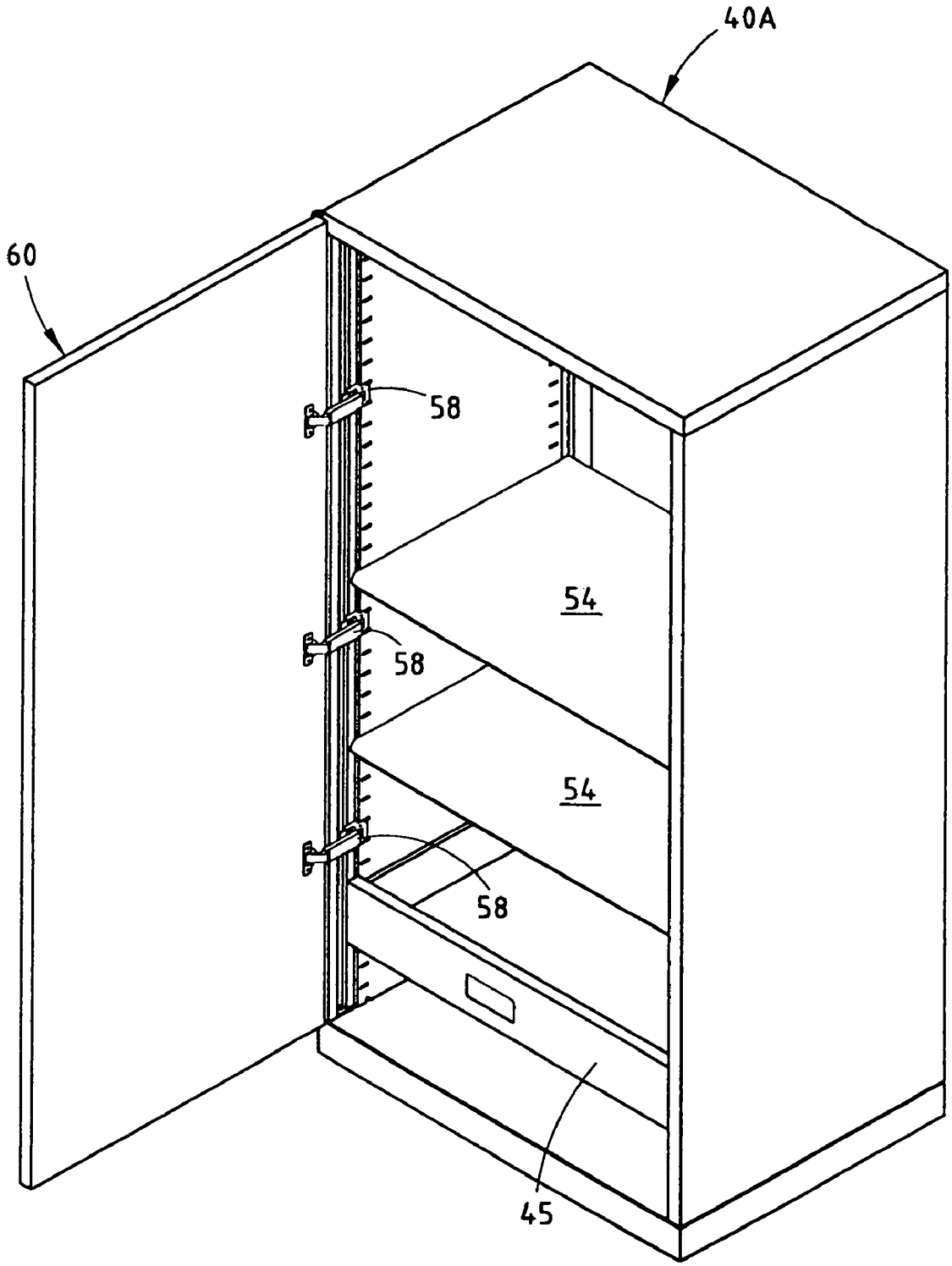
Figure 30:
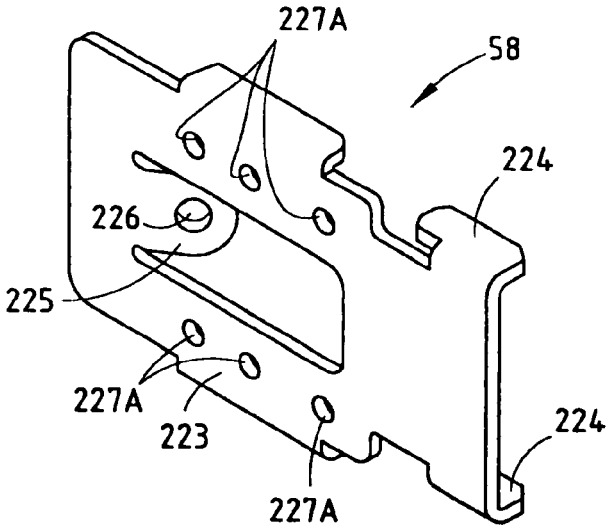
FIG. 30 is a perspective view of the hinge support bracket of FIG. 29
Figure 30A:
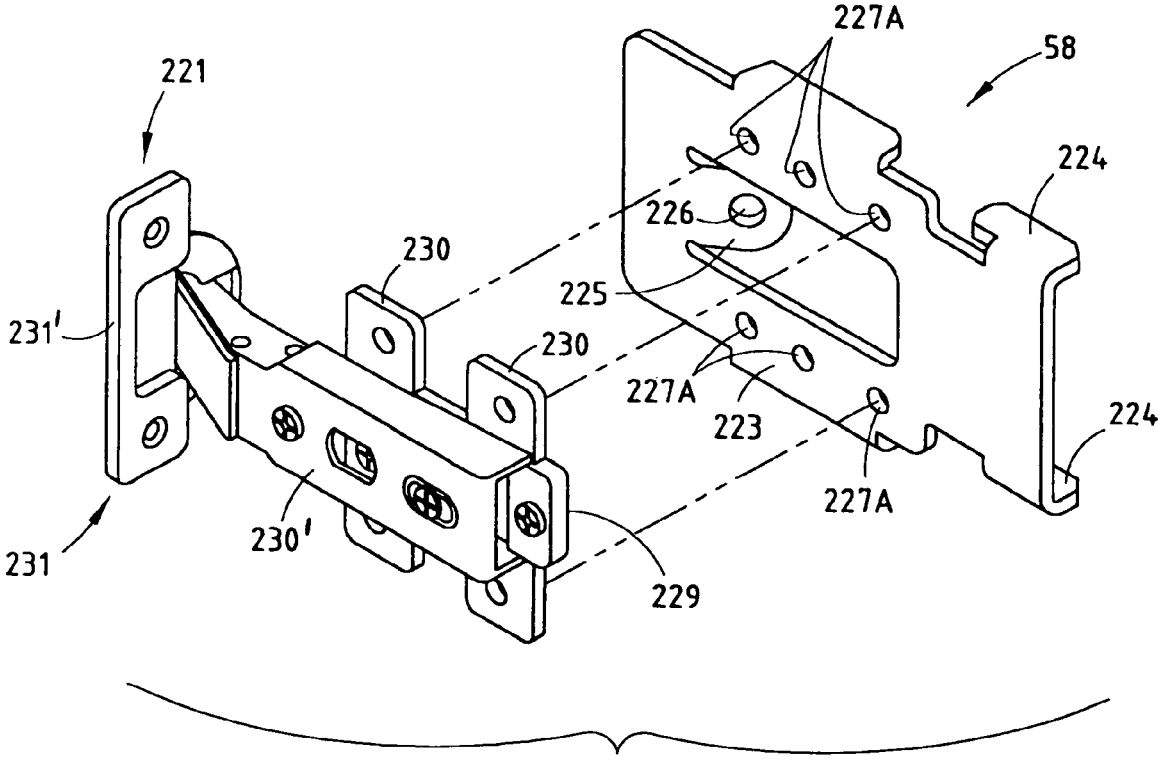
FIG. 30A is an exploded perspective view showing attachment of a hinge.
Figure 30B:
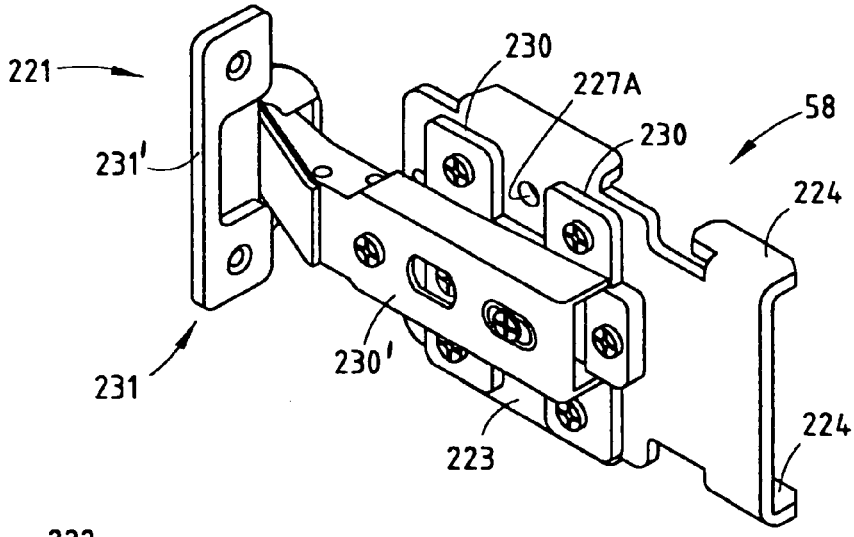
FIGS. 30B and 30C are perspective views of an proud-door hinge (see FIGS. 28-29) and an inset-door hinge (see FIG. 32), respectively.
Figure 32:
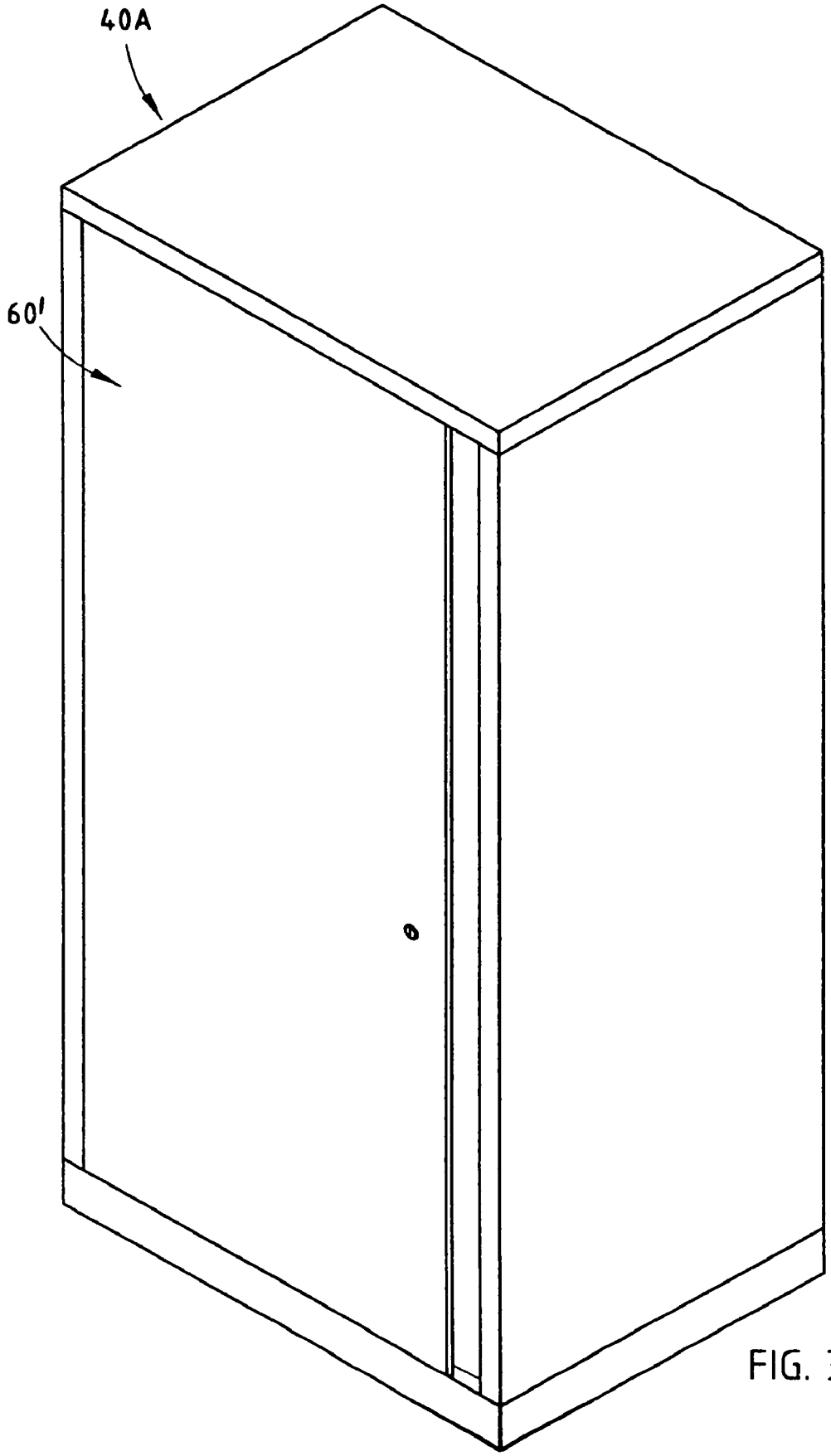
FIG. 32 is a perspective view of a cabinet similar to FIG. 28, but having a thin door positioned in an inset position, where the door edges lie within a perimeter of the cabinet side panels when the door is closed.
Figure 33:
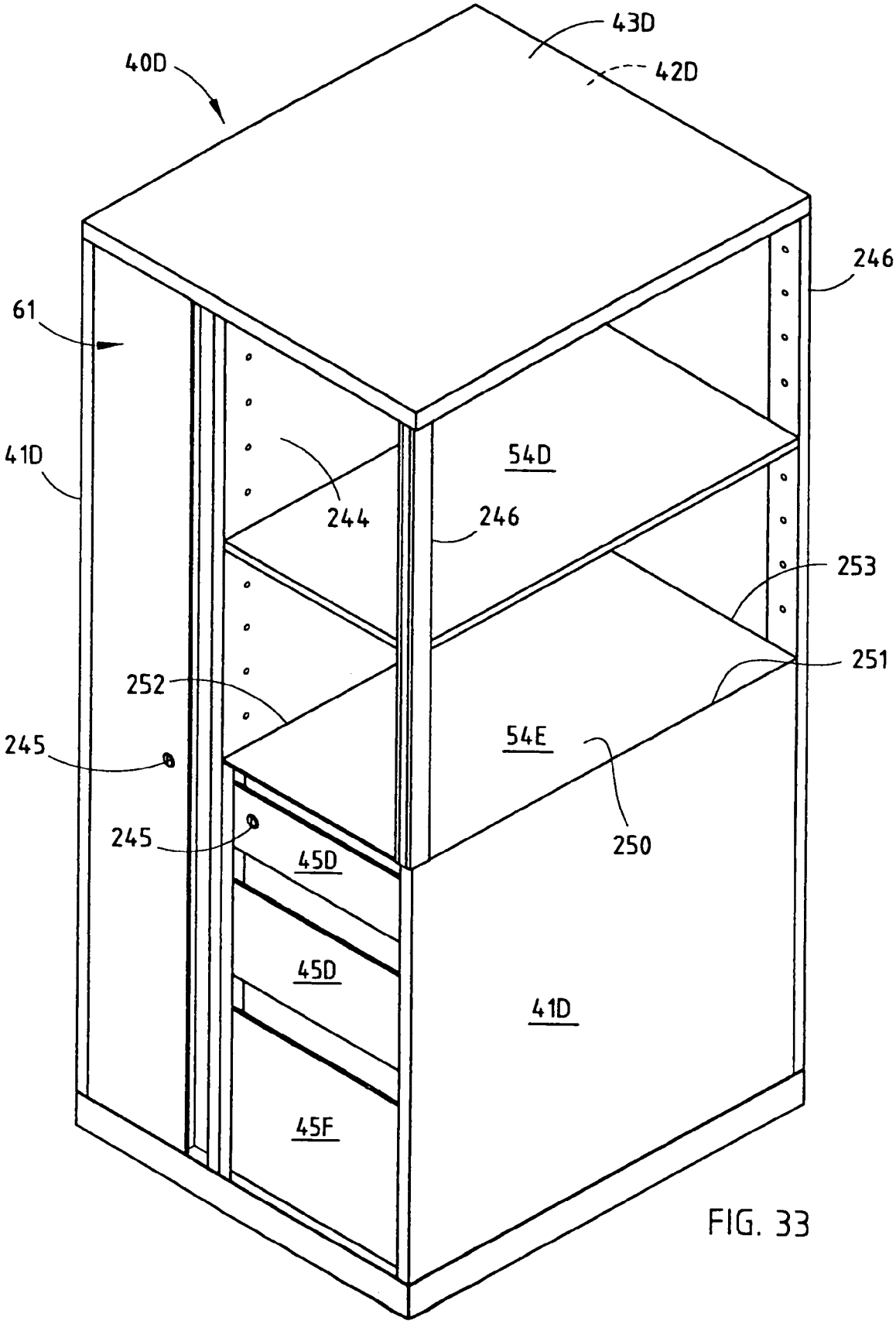
FIG. 33 is a perspective view of another modified cabinet, including a left half forming a tall closet with a lockable inset door, such as for hanging a coat therein, and a right half including lockable lower drawers and open top shelves.

A cabinet 40 (FIGS. 1-2) includes side panels 41, a back panel 42 and a top panel 43 that frictionally attach together with non-intrusive integrally formed connecting flanges and without separate fasteners. The illustrated base or bottom panel 44 is screw-attached, and includes openings 44' for routing wiring within the cabinet 40. Two drawers 45 and 46 are supported on drawer glides 47, respectively (FIG. 2). The drawer 45 includes a hollow header 48 which carries a lock 49, a cam 50 (FIG. 14) operably connected to the rear of the lock 49, and a bent horizontal lock rod 51 adapted to operably engage a vertical locking bar 52 (FIGS. 2, 12A and 14) in response to turning of the lock 49 and cam 50, as discussed below. Shelf brackets 53 (FIG. 18) are adapted to support shelves 54 in the cabinet 40B in either a flush condition or an inset condition (FIG. 18), and at different heights (FIG. 19) based on which cabinet slots 55 they engage and based on their orientation in those slots 55. A light-transmitting top panel 56 and light-transmitting top shelf 57 (FIG. 24) can be used to provide improved light within the cabinet. Hinge brackets 58 (FIG. 30) on the cabinet side panel 41 support either a thick storage door 59 with internal storage space (FIG. 27), a proud door 60 (FIGS. 28-29) or an inset door 61 (FIGS. 32 and 33).

Figure 3:
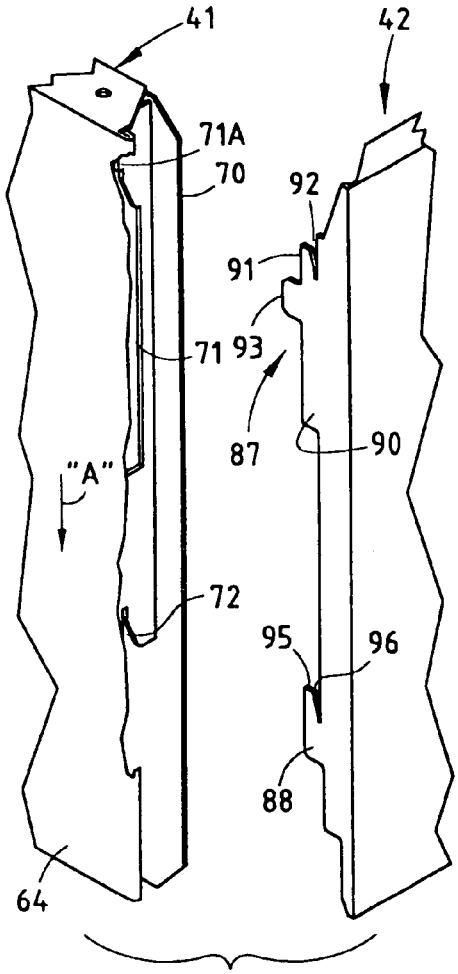
FIG. 3 is an exploded perspective view showing a side panel positioned for assembly to a back panel.
Figure 4:
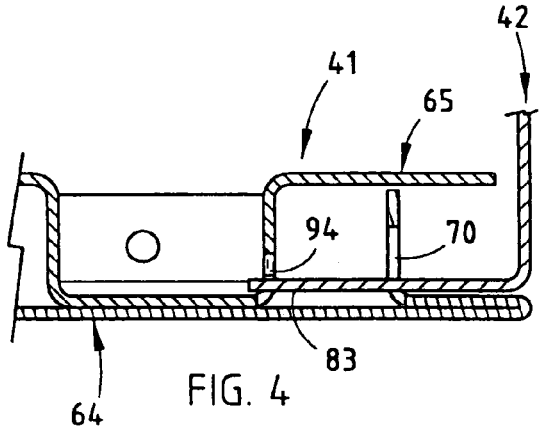
FIG. 4 is a cross section taken along the line IV-IV in FIG. 1, showing the connection of FIG. 3.
Figure 4A:
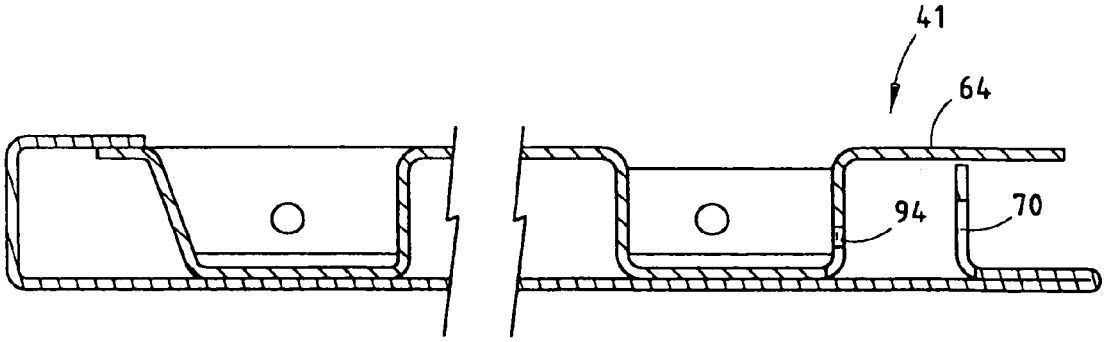
FIG. 4A is a cross section showing the side panel, similar to FIG. 4 but not showing the back panel.
Figure 5:
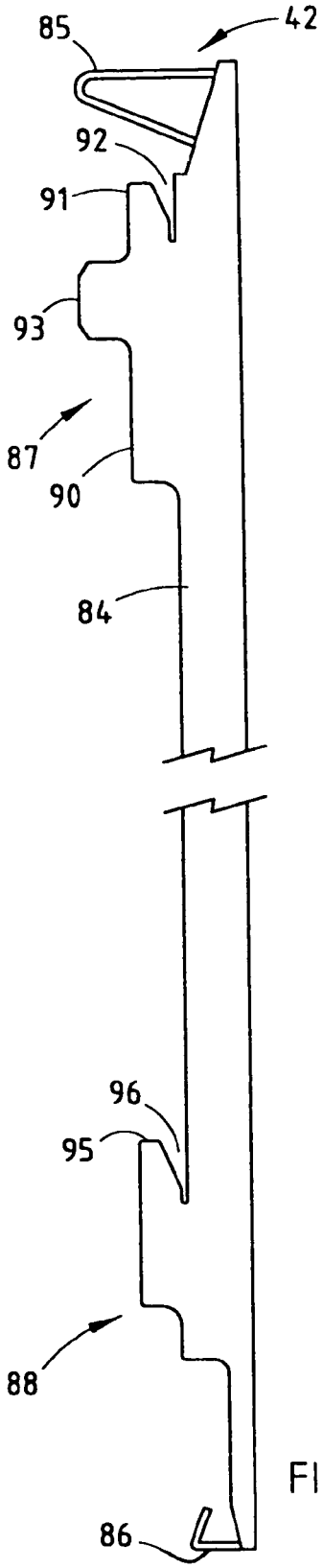
FIG. 5 is an elevated side view showing the side surface of the back panel including its attachment flange.
Figure 11:
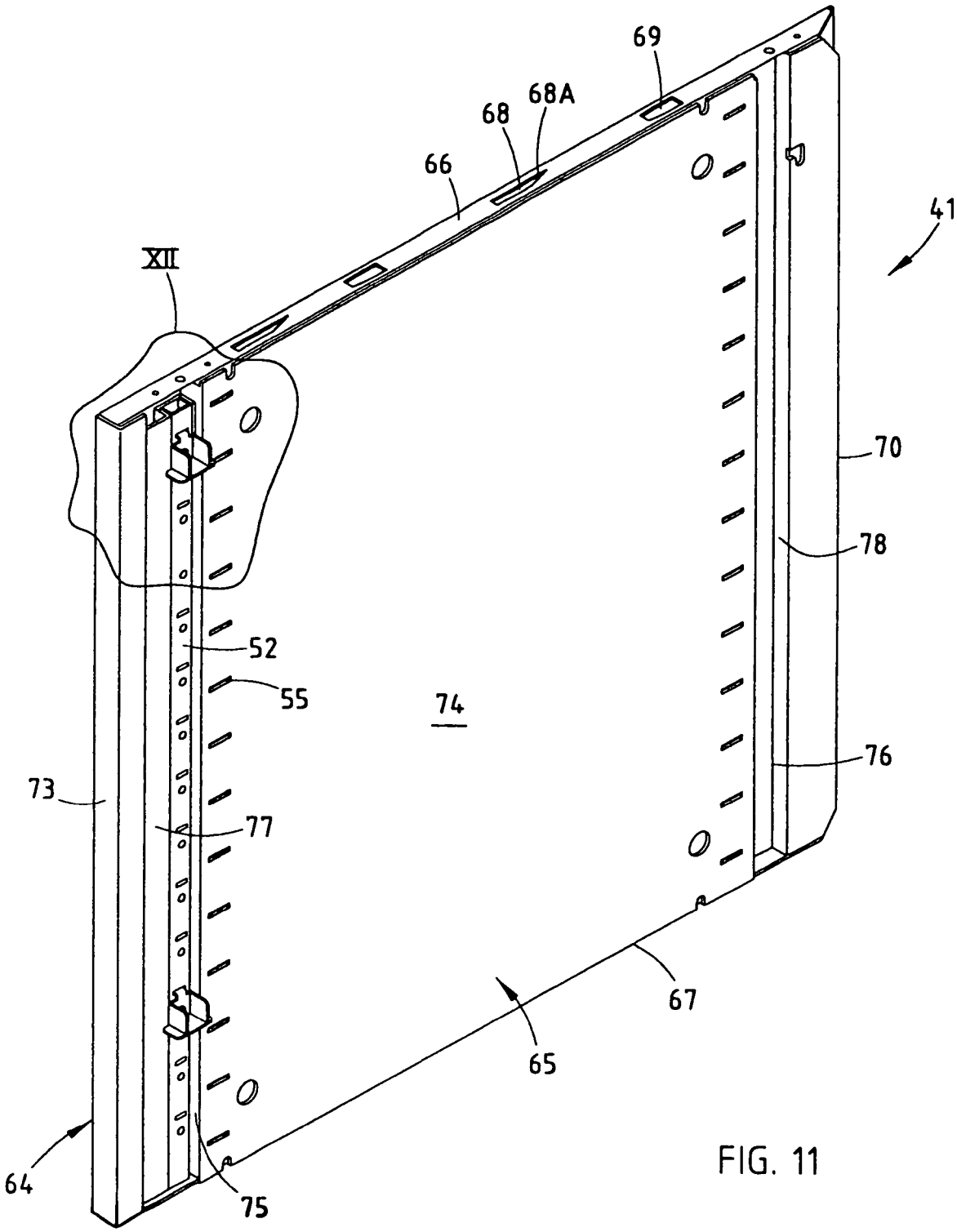
FIG. 11 is an enlarged perspective view of one of the side panels shown in FIG. 2, showing the vertical locking bar.
Figure 12:
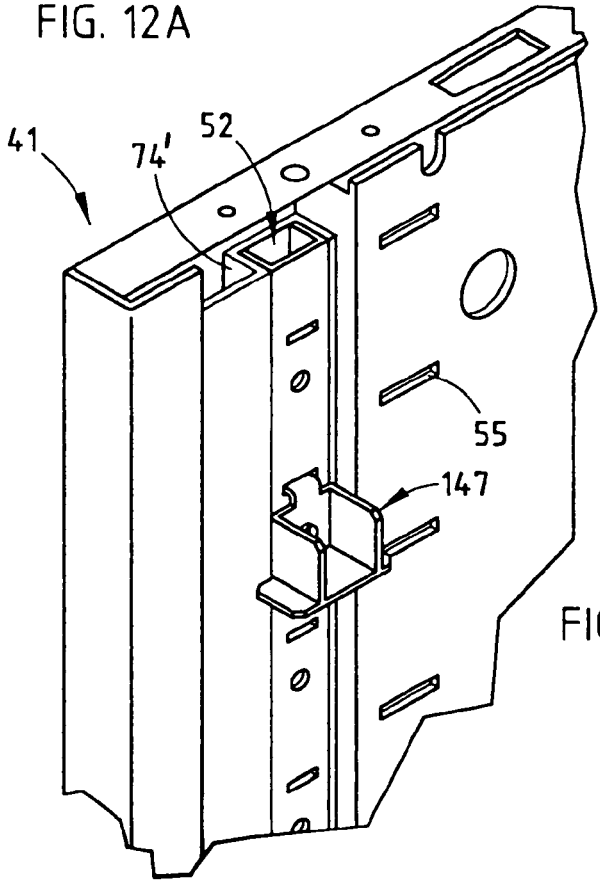
FIG. 12 is an enlarged fragmentary view of a front top corner of the side panel shown in FIG. 11.

Side panel 41 (FIG. 4) includes an outer sheet 64 and inner sheet 65 securely attached together, such as by adhesive, spot welding, or other means. The outer sheet 64 forms an outside of the cabinet 40, and includes top and bottom flanges 66 and 67 (FIG. 11) having an identical pattern of apertures 68 and 69, and further includes a rear flange 70 (FIG. 3) with apertures 71 and 72. The apertures 68 and 71 have a tapered end 68A (FIG. 11) and 71A (FIG. 3) that accurately position a connector hook slid mateably into the tapered ends, as described below. The front flange 73 (FIG. 11) is bent to form a planar front face with the front edge of the other side panel 41 and the bottom panel 44. The inner sheet 65 includes an inner flat wall 74 that extends parallel the body of the outer sheet 64, and includes front and rear flanges 75 and 76 forming front and rear vertical channels 77 and 78. A channel 74' (FIGS. 12 and 12A) fits into the channel 77 for supporting the locking bar 52 for vertical movement. The slots 55 are formed in vertical rows on the inner flat wall 74 adjacent the channels 77 and 78. The vertical lock bar 52 is adapted to slide vertically within the front channel 77, and is held therein by a bracket or flange 79 (FIG. 12). The two illustrated side panels 41 are identical and have identical patterns of apertures, but the closest side panel 41 is in an inverted "flipped" position relative to the other. By having both side panels be identical, it reduces work-in-process inventory and facilitates assembly.

Figure 6:
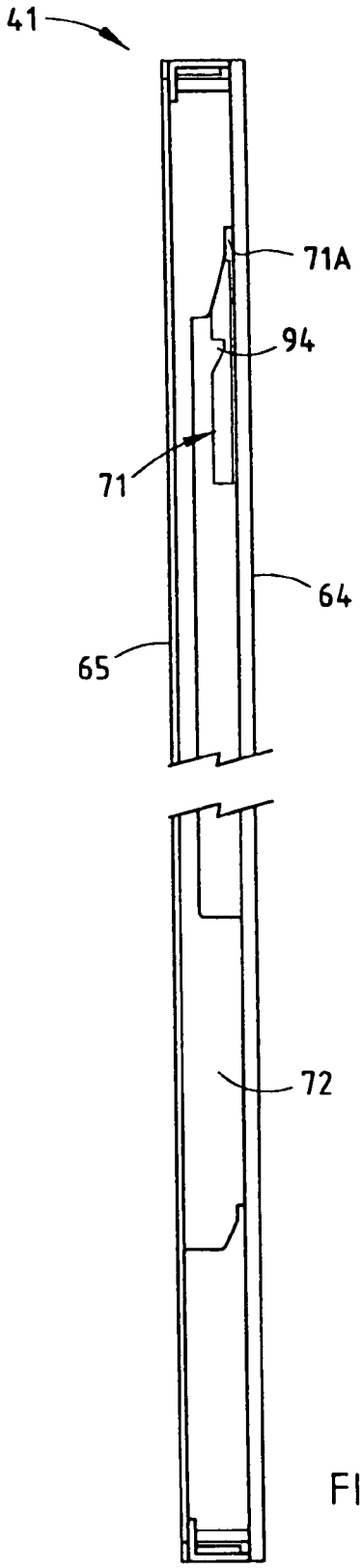
FIG. 6 is an elevated end view showing of a rear end surface of the side panel, the rear end surface being shaped to receive the attachment flange of the side panel in FIG. 5.

The back panel 42 (FIG. 2) includes a flat wall 82 forming a rear of the cabinet 40, and includes side flanges 83 and 84, a top flange 85 and a bottom flange 86. The side flange 83 includes a top hook structure 87 (FIG. 3) and a bottom hook structure 88. The top hook structure 87 includes a tab 90 with an arrow-shaped hook 91 and slot 92 at its upper end that extend in a direction parallel a length of the flange 83, and an interlock tab 93 that extends perpendicular to the hook 91. During assembly, the hook structure 87 is inserted into the aperture 71, and the hook 91 is slid into the tapered end 71A to an accurately aligned and frictionally interlocked position. A triangularly-shaped interlock tab 94 (FIGS. 4 and 6) on a rear edge of the inner sheet 65 engages the interlock tab 93 to securely hold the back panel 42 to a rear of the side panel 41. The bottom hook structure 88 (FIG. 3) on the back panel 42 includes a hooking tab 95 and slot 96 (similar to the tab 91 and slot 92) that are shaped to engage the mating aperture 72 on the side panel 41. The bottom hook structure 88 does not need to include an interlock tab like tab 93, since only one such tab 93 is required per side. It is noted that the top and bottom flanges 66 and 67 of the side panel 41 include an identical pattern of apertures so that, regardless of which edge is positioned upwardly, the same pattern of apertures 85A and 86A are present.

As is apparent from reviewing FIG. 2, the side flange 84 on back panel 42 is identical to the side flange 83, except the hook structures 87 and 88 on side flange 84 are vertically reversed. The reason for this is so that two identical side panels 41 can be used, thus reducing manufacturing cost for making a second side panel that is a mirror image of the first side panel. Specifically, the left side panel 41 is assembled to the back panel 42 by inserting the hook structures 87 and 88 into the apertures 71 and 72, and then by moving the left side panel 41 downward in direction "A" relative to the back panel 42 until the interlock tab 93 on the back panel 42 engages the interlock tab 94 on the side panel 41 to prevent disengagement. The tab 93 also prevents misassembly (i.e., prevents the side panels 41 from being assembled when facing "inside out"). The location, shape, and orientation of the tab 93 are believed to be innovative and inventive, since this was not easily designed. The right side panel 41 is assembled to the back panel 42 by inserting the hook structure 87 and 88 into the apertures 71 and 72, and then by moving the right side panel 41 upwardly in direction "B" until the "right side" interlock tab 93 engages the corresponding interlock tab 94.

Figure 7:
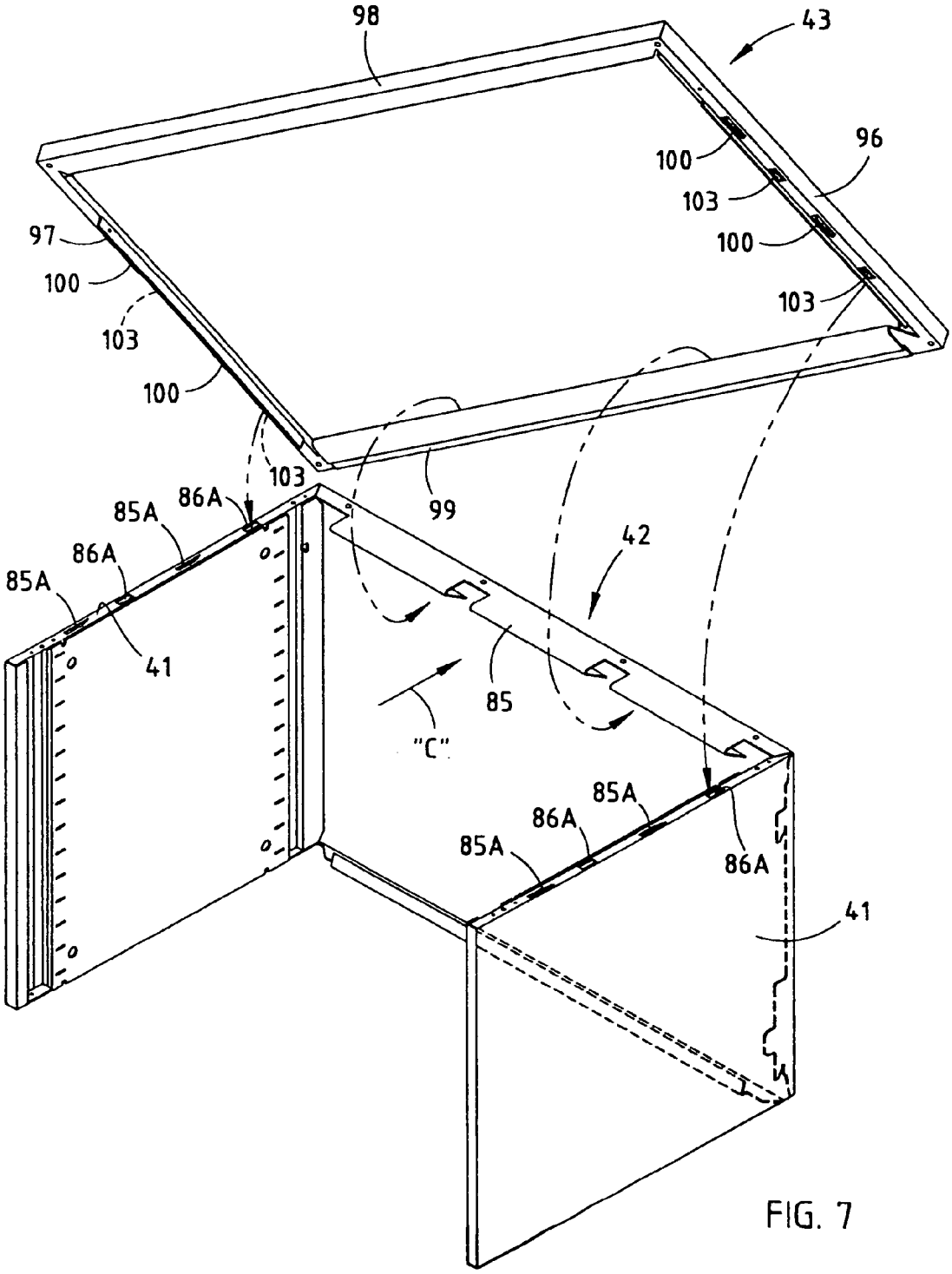
FIG. 7 is an exploded perspective view showing a back panel and two side panels assembled together, and showing a top panel being positioned for assembly.
Figure 7A:
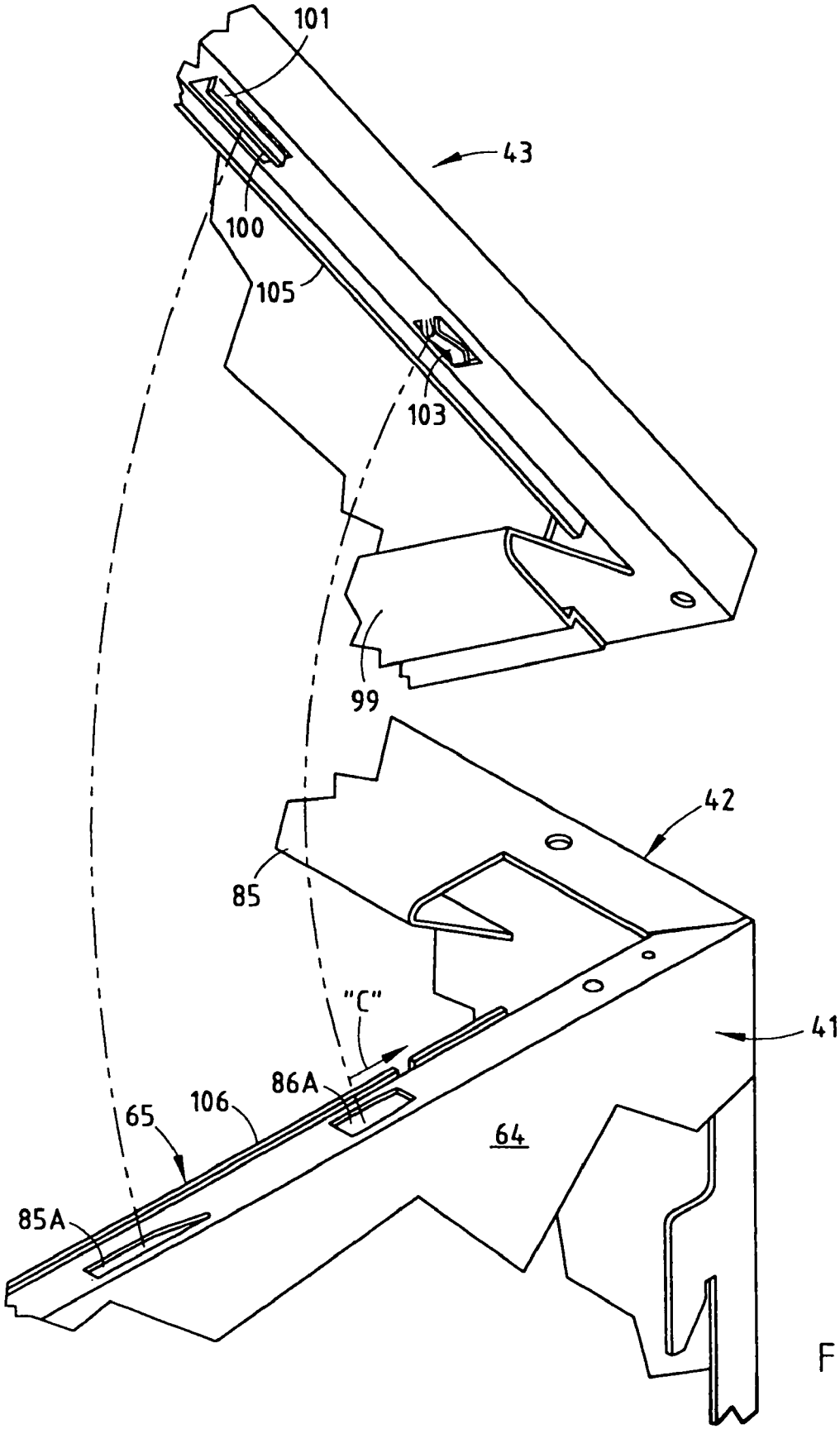
FIG. 7A is an enlarged perspective view of the connecting portions of the back, side and top panels in FIG. 7.

FIGS. 7 and 7A show the top panel 43 and further show assembly of the top panel 43 to the subassembly of the side panels 41 and the back panel 42. The top panel 43 forms an outer top wall of the cabinet 40, and includes right and left edge flanges 96 and 97 that are mirror images of each other, and further includes front and rear edge flanges 98 and 99. The right and left edge flanges 96 and 97 are each configured to lie abuttingly flat against a top surface of the top flanges of the side panels 41. The edge flanges 96 and 97 each include a horizontally/rearwardly extending hook 100 with slot 101 shaped to fit into and then horizontally engage a tapered narrow end of the aperture 85A as the top panel 43 is slid rearwardly relative to the side panel(s) 41 in direction "C". The edge flanges 96 and 97 also include a leaf-spring-like finger 103 that is shaped to fit into and then horizontally frictionally engage the end of the aperture 86A. It is noted that the body of hook 100 is oriented vertically, while the body of finger 103 is oriented horizontally, such that the combination frictionally attaches to the side panels 41 with a strong and reliable stable force, and in a relatively accurate location to form an optimal and aesthetically-acceptable square corner for the cabinet 40. A flange 105 (FIG. 7) on top panel 43 extends vertically/downwardly from the edge flanges 96 (and 97) at a location inside of an edge flange 106 on the inner sheet 65 of the side panel 41. The flange 105 overlaps the flange 106 to further provide alignment and stability to the assembly of the top panel 43 to the side panels 41. It is contemplated that the top panel 43 will be made from an inner sheet and an outer sheet adhered and/or spot-welded together, but it is conceived that different top panels can be constructed using the concepts disclosed herein.

Figure 8:
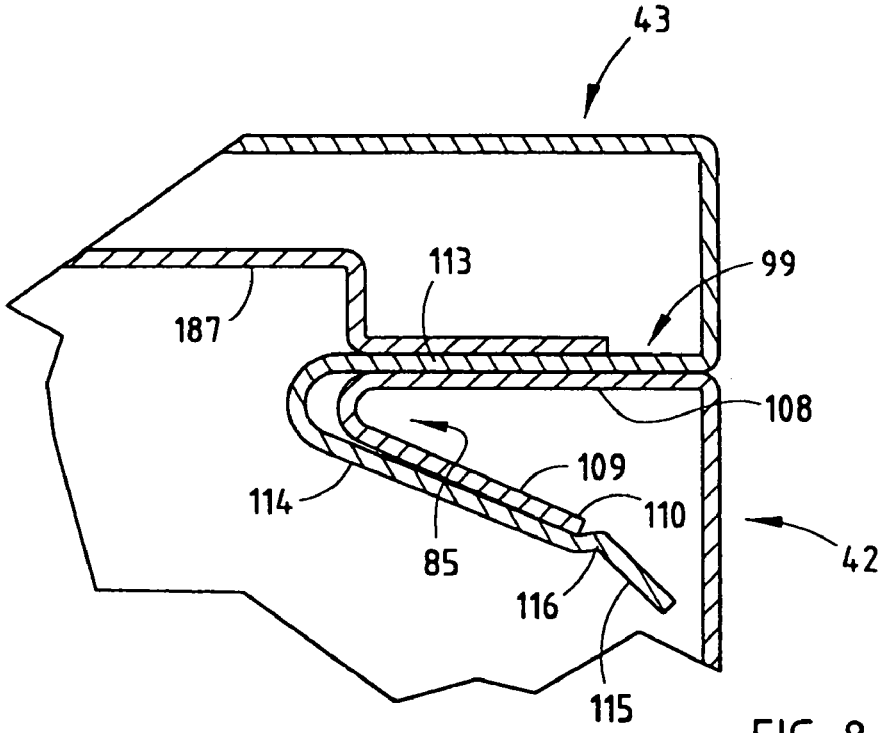
FIG. 8 is a cross section showing the assembled connection of the top panel to the back panel.

The top edge flange 85 of the back panel 42 (FIG. 8) includes a first portion 108 and a reversely-bent angled second part 109 with a free end 110. The top panel 43 includes the rear edge flange 99, which has a planar part 113, a reversely-bent angled part 114, and a free end 115. The free end 115 is offset from the angled part 114 such that it defines a ridge 116. The top edge flange 85 is shaped to snap into the rear edge flange 99, with the first portion 108 abuttingly lying flat against the planar part 113, and with the angled second part 109 abuttingly lying substantially flat against the angled part 114. When assembled, the free end 110 snaps inside of the ridge 116 to retain the connection together. It is noted that the angle of the part 114 is slightly greater than the angle of the part 109, such that the free end 110 snaps with a positive force into and is captured within the top edge flange 85. Notably, the rear edge flange 99 and the hook 100 and finger 103 simultaneously engage the respective components on the back panel 42 and the side panels 41 as the top panel 43 is moved rearwardly in direction "C" relative to the panels 4142.

In the illustrated assembly of the side, back, and top panels 4143 (FIG. 2), no separate fasteners are used or needed, although they can be added for additional strength if desired. This elimination of fasteners greatly facilitates assembly by improving the efficiency of the assembly and by reducing parts and pieces required for assembly. Further, an additional benefit can be achieved. The panels are not attached by an intrusive attachment, such as a screw or other fastener that would cut into the panel and break the paint coating and corrosion-resistant coatings on the panels. Further, the panels 41-43 are not welded or physically affected in a way that will show through the panels 4143 to a show surface, creating a visible surface blemish or defect. Thus, the panels 41-43 can be painted before assembly to each other (i.e. as they are shown in FIG. 2), instead of after assembly to each other. This is highly desirable, since after panels 41-43 are assembled, they define an enclosure that is relatively deep and difficult to reach into in order to adequately coat the inside corners of the cabinet with paint. Contrastingly, the present panels 4143 can be painted while separate from each other and still in a substantially flat condition. This leads to a more reliable painting process with less defects and less quality problems. Further, the painting process is more easily automated, which helps eliminate undesirable manual spraying operations. It also gives the manufacturer an option of powder coating or using other painting processes that produce less pollution and less environmental hazards, and an option of providing a more uniform coating where the thickness of the paint coating away from the corners is the same as the painting at the corners. The present panels 4143 are releasably attached, which allows for tear down and replacement of components that are damaged after manufacture. Still further, the cabinets can be shipped in a knocked-down condition, which facilitates shipping them in a dense arrangement, saving shipping costs. At the same time, assembly is controlled and is achievable with few separate fasteners and with a minimum of extra pieces.

Figure 10:
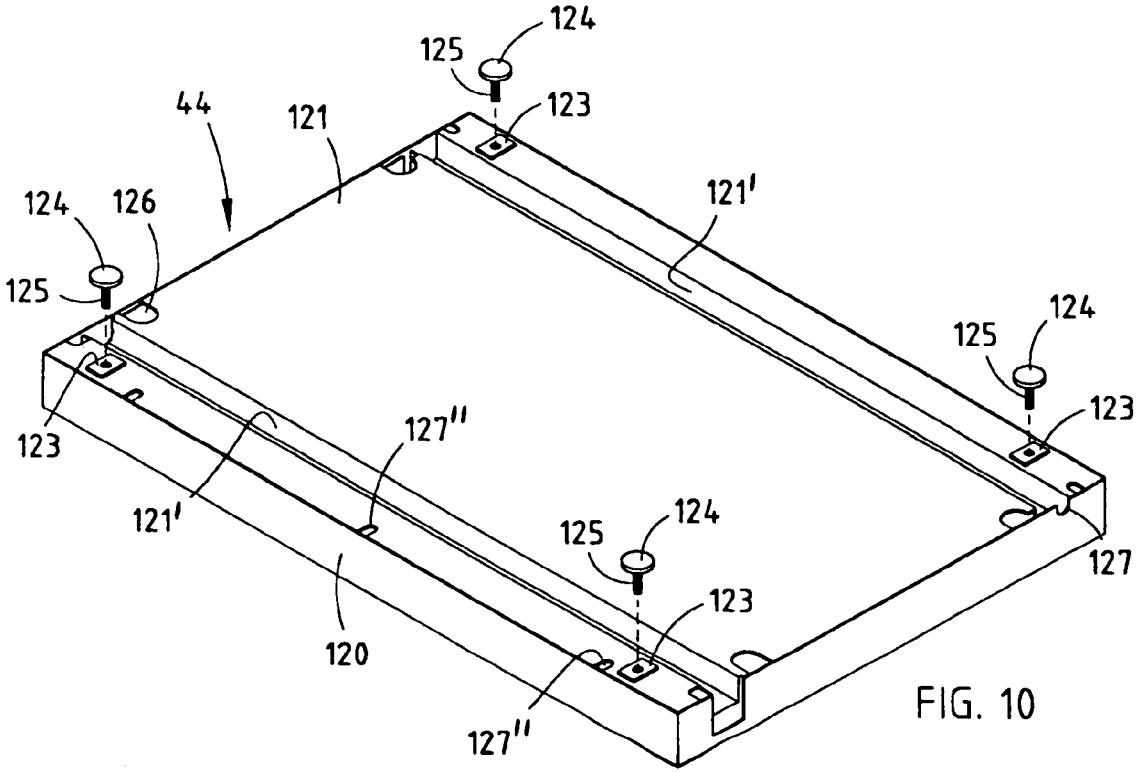
FIG. 10 is a perspective view of a bottom surface of the bottom panel.
Figure 9:
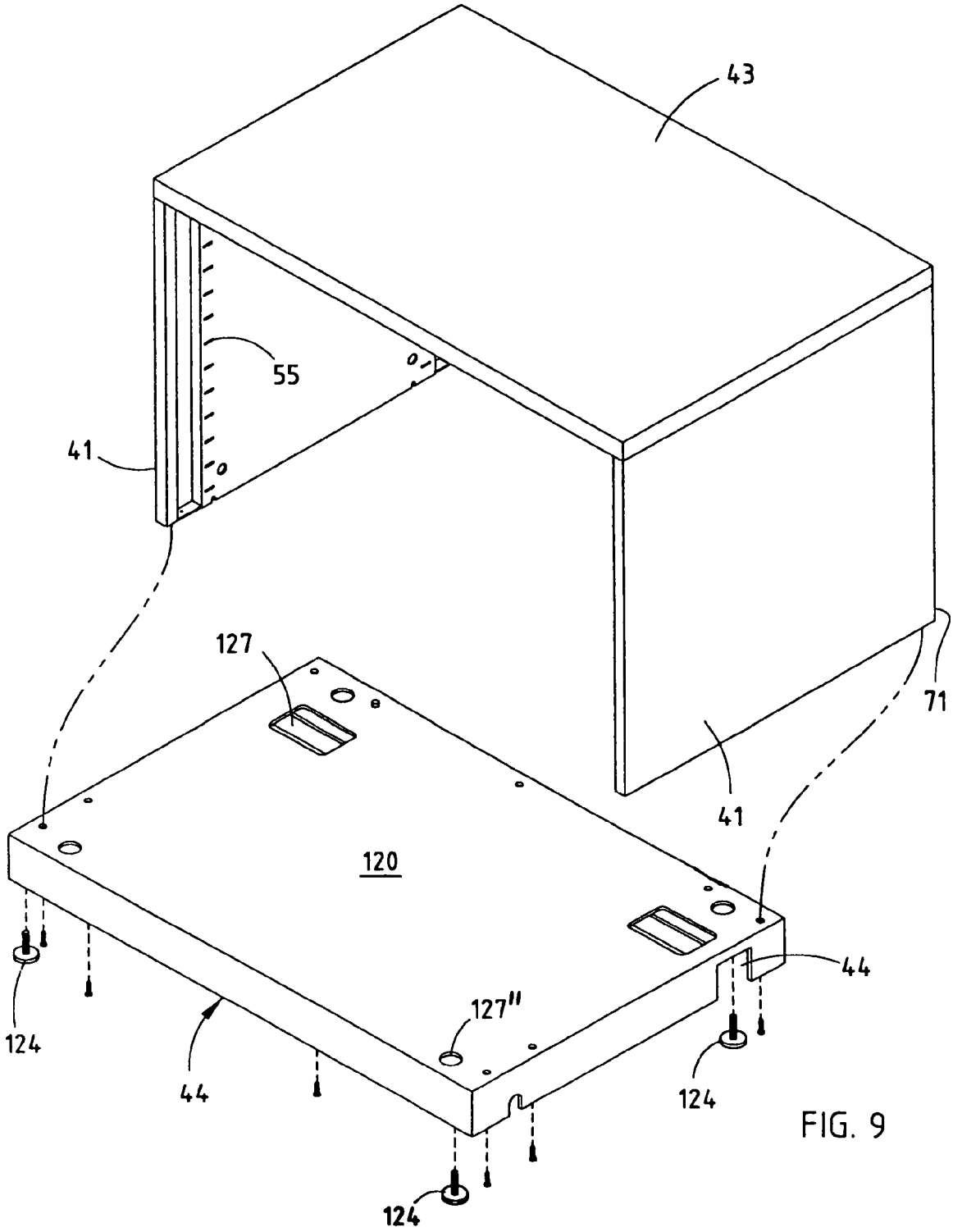
FIG. 9 is an exploded perspective view showing a subassembly of two side panels, a top panel (and a back panel) assembled together, and showing the bottom panel positioned for assembly.

A sturdy base or bottom panel 44 (FIGS. 2, 9, and 10) is provided for supporting the assembly of panels 41-43. The illustrated bottom panel 44 includes a top sheet 120 (FIG. 2) forming a portion of an inside of the cabinet 40, and a bottom sheet 121 (FIG. 10) forming an outer floor-adjacent surface of the cabinet 40. The sheets 120 and 121 can be adhered or welded together, or secured in other ways known in the industry. The top sheet 120 (FIG. 2) includes top, front, and side flanges forming outer surfaces of the cabinet 40, and the bottom sheet 121 (FIG. 10) includes flanges bent to support the top, front, and side flanges of the top sheet 120. In particular, the front and rear flanges of the bottom sheet 121 form channels 121' that extend parallel the front and rear edge of the cabinet 40 and that stiffen the bottom panel 44 as required for cabinet stability. Weld nuts 123 are attached to the bottom sheet 121 for supporting adjustable cabinet feet 124. In particular, the feet 124 include threaded shafts 125 that threadably adjustably engage the nuts 123. It is contemplated that the threaded feet 124 can be eliminated in some applications. Apertures 126 and/or 127 are cut into the edges of the bottom sheet 121 or into the flanges of top sheet 120 for routing wiring. The apertures 126 and 127 are positioned to allow the wiring to be routed across the bottom panel 44 from one side to another side (for example see FIG. 1), or to allow the wiring to be routed up into the cabinet through the bottom panel 44 to whatever height is desired within the cabinet 40. (See FIG. 33.) Other apertures 127" (FIG. 2) provide access for positioning screws 129 (FIG. 2) or for positioning tools for driving the screws 129, such as screwdrivers and power hand tools. When driven into position during assembly of the bottom panel 44 to the other panels 41-43, the screws 129 include a head that abuts the underside of the top sheet 120, and a shaft that extends through the top sheet 120 threadably into the associated flange on the side panels 41 and/or the back panel 42.

Hat-shaped stiffeners 131 (FIG. 2) can be adhered to or otherwise attached to the inner surface of panels 4144 for additional stiffness where desired. The stiffeners 131 can extend vertically or horizontally, depending on specifications of the cabinet 40. Notably, the illustrated stiffener 131 on the back panel 42 creates a corner space for wiring to be routed upwardly along an inner surface of the back panel 42 without fear of being pinched by a shelf 54 (since the shelf 54 is held forwardly by the stiffener 131). Wiring can also be routed vertically or horizontally through the channel if desired.

Drawers 45 (and 46) (FIG. 2) are attached by drawer glides 47 and 48. A variety of drawer glides are known in the industry, such that a detailed description of them is not required for an understanding by a person skilled in this art. The illustrated drawer glides 47 and 48 include a stationary part 134 attached to the associated side panel 41 by integrally formed hooks 136, and a movable drawer-supporting part 135 attached to a side of the drawer 45 by integrally formed hooks 137. The illustrated stationary part 134 is attached to the side panel 41 by integrally formed hooks 136, but it is contemplated that the stationary part 134 could be attached by other means, such as by screws or brackets that engage the slots 55 in interior sidewalls of the side panels 41, in a manner similar to the brackets 53. Similar variations in attachment are contemplated for the movable part 135.

Figure 15:
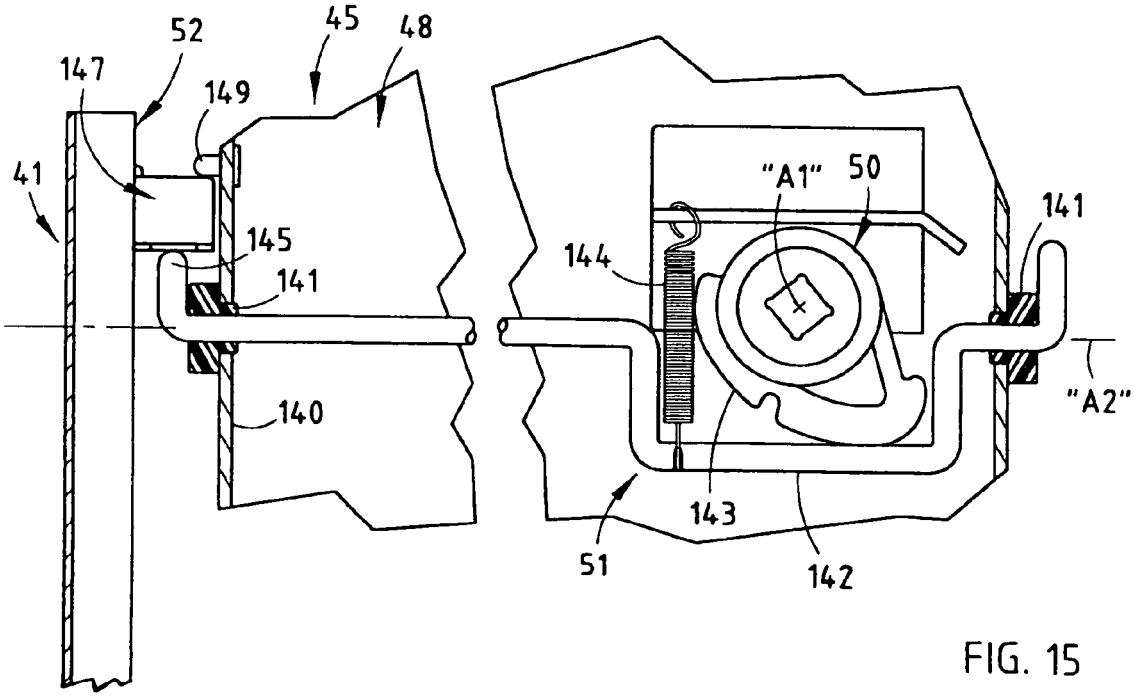

The header 48 of top drawer 45 (FIG. 2) is hollow, and includes side flanges 140 having holes with bushings 141 (FIG. 14) that rotatably support the lock rod 51. The lock 49 includes a keyed lock tumbler (not specifically shown) with the cam 50 attached to its rear end. The cam 50 includes a spiral camming surface 143 shaped to abuttingly engage a bent section 142 of the lock rod 51. A spring 144 biases the bent section 142 continuously against the camming surface 143. The end 145 of the lock rod 51 is bent to engage a first flange 146 on a lock bracket 147. The lock bracket 147 is fixed to the vertical lock bar 52 and includes a second flange 148 shaped to engage a lock pin 149 on the drawer 45. When the tumbler of the lock 49 is rotated to a locking position (FIG. 14), the cam 50 rotates about a first horizontal axis A1, causing the lock rod 51 to rotate about a second axis A2. As the lock rod 51 rotates toward its locking position, the end 145 engages the first flange 146, lifting the lock bracket 147 in direction "D" so that the second flange 148 interferes with the lock pin 149. Thus, when in the locking position, the drawer 45 cannot be opened, since lock pin 149 strikes second flange 148 preventing the drawer 45 from opening. The lock bar 52 can include multiple lock brackets 147, such that, when lock bar 52 is lifted, all drawers (including drawer 46) are locked closed and cannot be opened. When the lock 49 is rotated to an unlocked position (FIG. 15), the cam 50 (along with spring 144) causes the lock rod 51 to rotate to an unlocked release position, such that lock bar 51 drops downwardly. In the unlocked position, the second flange 148 is misaligned with the drawer lock pin(s) 149, such that all drawers can be opened.

The arrangement of the lock components 49-51 being within the drawer header 48 is believed to be novel, nonobvious, inventive, and very beneficial. For example, the drawer header 48 is in a very accessible position where it can be easily assembled, maintained, and fixed/repaired. At the same time, the arrangement is very secure, since it cannot be reached when the drawer(s) is closed (and locked). Further, by the present arrangement, the locking components are more closely associated with and integral with the drawer header. Specifically, they actually become a part of the drawer, instead of requiring separate mounting structure on the cabinet. This facilitates assembly, shipping, and customization during assembly, and also helps reduce alignment problems caused by mismatch of components on the cabinet versus the drawers. It also eliminates a mid-level fixed crossbar that traditional cabinets have across their front opening between drawers. This results in an increase in useable space in the cabinet enclosure.

Figure 16:
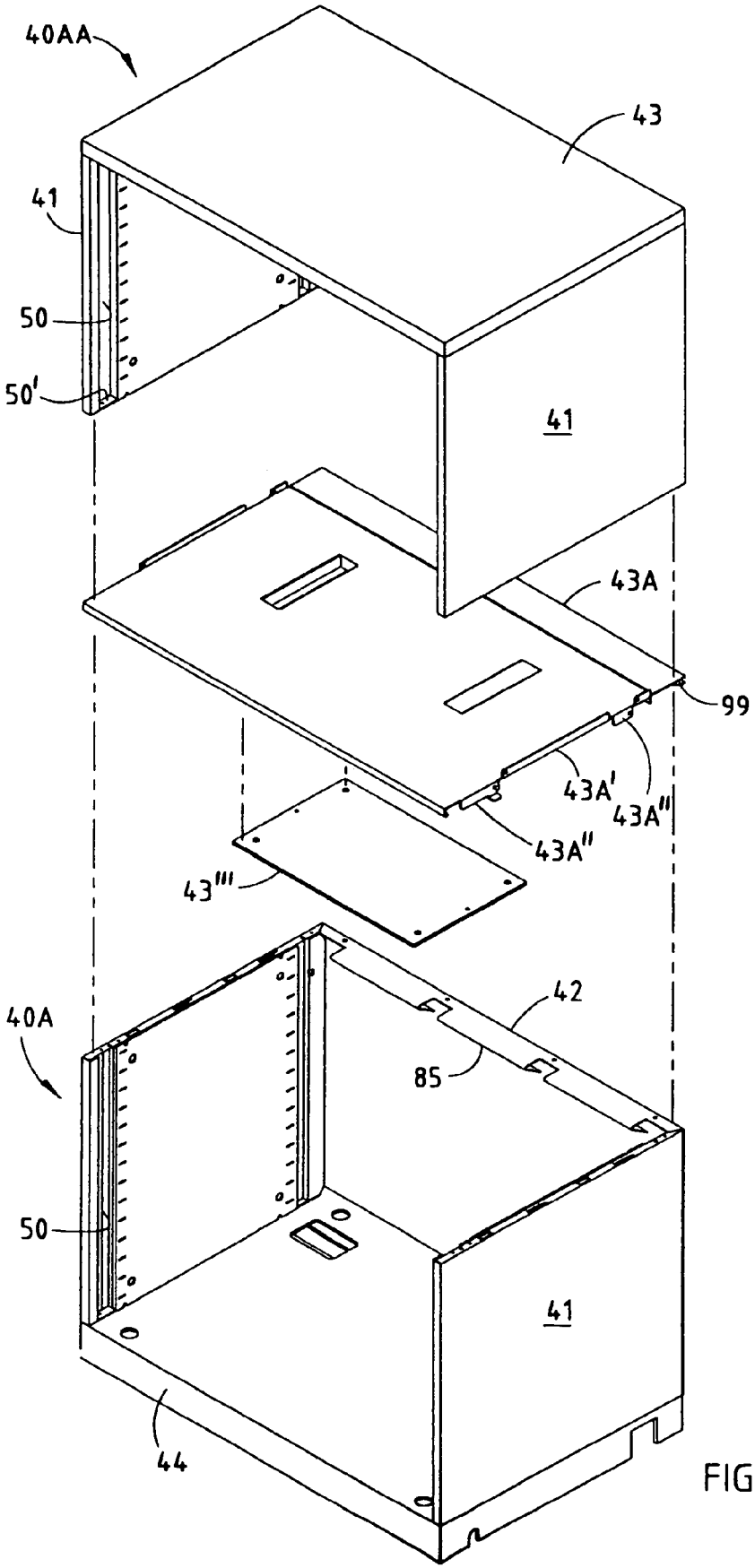
FIG. 16 is an exploded perspective view of a two-drawer top cabinet positioned for assembly on a two-drawer bottom cabinet in a forwardly facing portion (the top cabinet also being rotatable and attachable in a rearwardly facing position on the bottom cabinet)

FIG. 16 shows a cabinet structure 40AA mounted on a second (lower) cabinet structure 40A. In the illustrated arrangement, the top panel 43 of the lower cabinet 40A has been eliminated, and an intermediate security/separation panel 43A of the top cabinet structure 40AA includes flanges 43A' screwed to the side panels 41 of the top cabinet structure 40AAA, and down flanges 43A" screwed to the side panels 41 of the bottom cabinet structure 40A. Also, the intermediate panel 43A includes a rear flange 99 shaped to engage the "arrow-shaped" flange 85. A weight plate 43A'" can be added for increased stability. Notably, the top cabinet structure 40AA rests directly on the bottom cabinet structure 40A, and the intermediate panel 43A does not add to overall height of the assembly. This is highly advantageous, since "stacked" cabinets 40A/40AA have the same height as other cabinets in the product line (without having to have special or custom-made side panels). This is believed to be a novel and inventive concept, and is believed to be a substantial commercial advantage. It is conceived that the top cabinet structure 40AA can have its front opening face in the same direction as the lower cabinet structure 40A as illustrated. Alternatively, the top cabinet structure 40AA can be oriented to face at 90 degrees or 180 degrees to the bottom cabinet 40A. When oriented in the same direction or at 180 degrees, it is possible to couple the top lock bar 50 to the bottom lock bar 50A through a hole 50' in the bottom panel 43, such that all drawers are locked by a single lock.

Figure 16A:
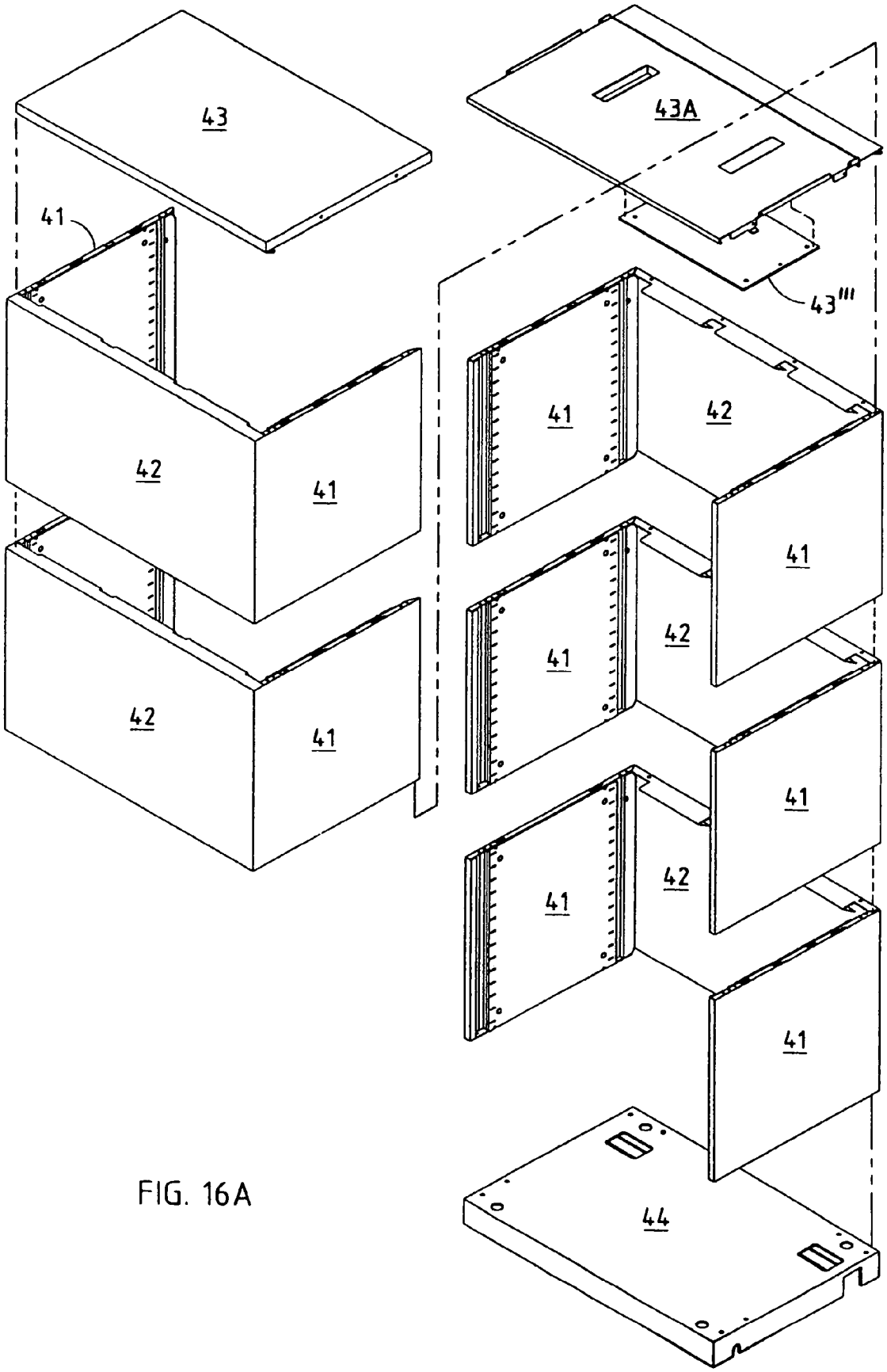
FIGS. 16A, 16B, and 16C are exploded, front, and rear perspective views of a five-tier modular assembly of smaller cabinets.
Figure 16B:
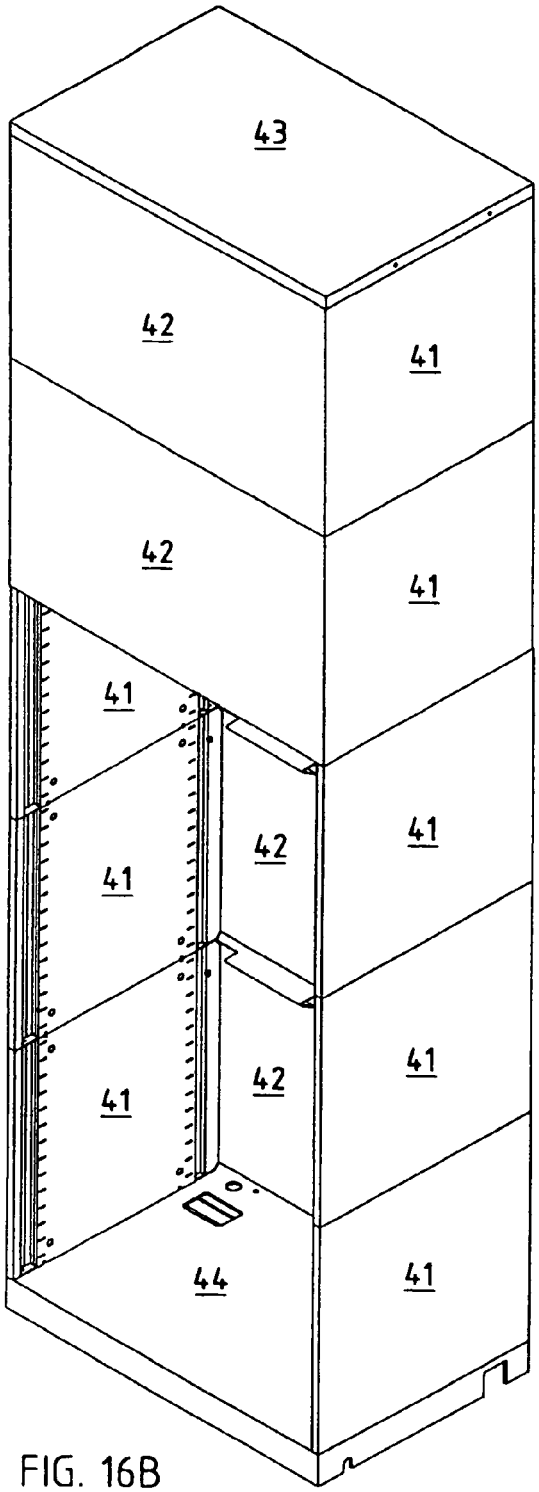
Figure 16C:
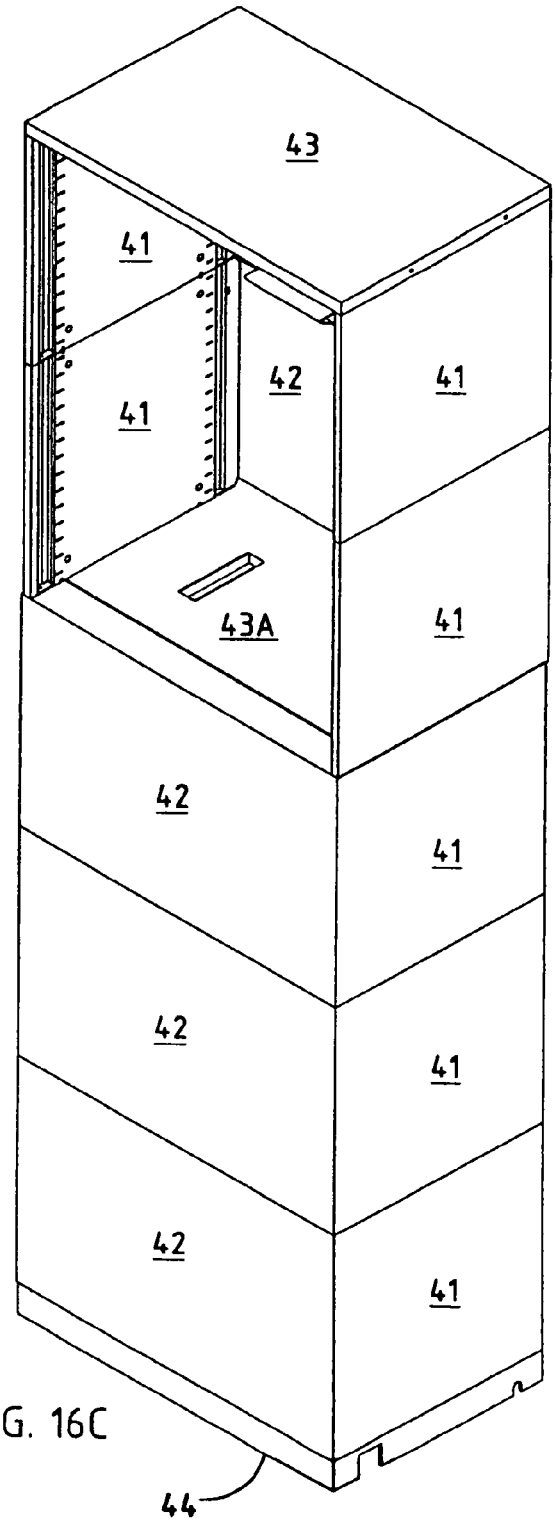

FIGS. 16A-16C illustrate a "five tier" assembled cabinet, using a base 44, three subassemblies 41/42/41 facing a first direction, and intermediate panel 43A, a weight plate 43'", two oppositely facing subassemblies 41/42/41, and a top panel 43. Drawers, doors, and/or shelves can be added as desired.

A tall cabinet 40B (FIG. 17) can be constructed using panels 41B-44B identical to panels 41-44, but with the side and back panels 41B and 42B vertically elongated. The side and back panels 41B and 42B can include additional hook-connecting structures as needed to maintain a tight fit that resists bowing. The illustrated tall cabinet 40B includes a single drawer 45B, two horizontal shelves 54 and 54A, and an angled shelf 54B. The shelves 54 and 54A are identical, but the top shelf 54 is supported with its front edge 152 in a forward position flush with a front surface of the side and top panels 41B and 43B of cabinet 40B, while the bottom shelf 54A is supported with its front edge 152A in an inset or recessed position. The shelf 54B is also identical to shelf 54, but is inverted front-to-rear such that an up flange 172 is located at a front of the shelf, as discussed below.

Figure 20:
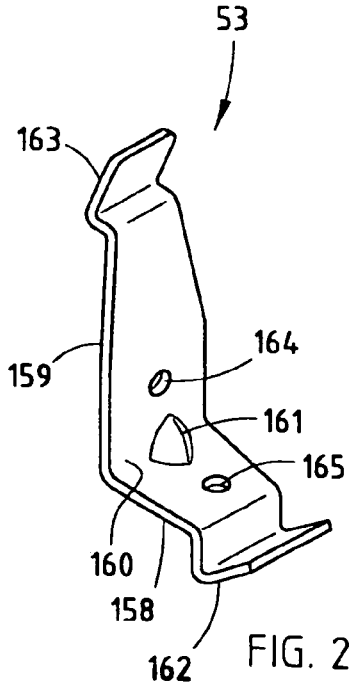
FIG. 20 is a perspective view of the shelf bracket shown in FIGS. 18-19.

More specifically, the top shelf 54 (FIG. 18) includes a flat sheet 153, a front edge 152 formed with a down flange 154 for stiffness, and a side edge formed with a second down flange 155 for stiffness. Two front notches or gussets 156 and 157 are formed at the corner of the second down flange 155 and the flat sheet 153 near a front area corresponding to the front slots 55 in the side panels 41B of the cabinet 40B, and two rear notches or gussets (not specifically shown) are formed at the corner of the flange 155 and the flat sheet 153 near a rear area corresponding to the rear slots 55 in the side panels of the cabinet 40B. The notches 156 and 157 form depressions on an underside of the shelf 54. The shelf bracket 53 (FIG. 20) is a sheet metal part stamped into an "L" shape to include a short leg 158 and a long leg 159 joined at a corner 160. The corner 160 (FIGS. 19-20) includes a "camelback" gusset 161 that extends at an angle between the legs 158 and 159. The end 162 of short leg 158 is L-shaped, and is configured to slip into a selected slot 55 and non-removably lock into the selected slot 55 when the leg 158 is positioned adjacent the side panel 41B. In this position, the long leg 159 extends horizontally into the cabinet, where it supports the shelf 54. The long leg 159 has an end 163 that is L-shaped and similar to end 162 of the short leg 158. However, the end 163 of the long leg 159 does not interfere with the shelf 54 since it is bent away from the shelf. When shelf 54 is positioned on the bracket 53, the notch 156 (or 157) rests on the bracket gusset 161, thus securely holding the shelf 54 in a selected forward/flush condition or in a selected rearward/inset condition. (See shelf 54A.) Holes 164 and 165 are provided in the legs 158 and 159 for receiving a screw to permanently secure the shelf 54 to the bracket 53. This also secures the bracket 53 in the selected slot 55, since when the bracket 53 is fixed to the shelf 54, the bracket 53 is held in a vertical orientation preventing the bracket 53 from being removed from its selected slot 55. The screw is optional and need not be used, but when used, the screw does create a more rigid structure, thus adding to the stability and rigidity of the shelf 54 as well as the cabinet 40B. An up flange 172 at a rear edge of the shelf 54 prevents items from sliding off a rear of the shelf into a back of the cabinet.

Notably the bracket 53 can be inverted (see FIG. 19), such that the end 163 of the long leg 159 is engaged with a slot 55, and the short leg 158 is extended under the shelf 54. This is advantageous for the following reason. The slots 55 are located a distance 167 apart. The legs 158 and 159 have lengths chosen to support the shelf 54 at heights that are a distance 168 apart. The distance 168 is half the distance 167, such that the shelf 54 can be positioned at twice as many locations 169 as there are slot locations. This reduces the number of slots 55 required in the side panels 41, thus saving manufacturing costs, providing longer tooling life, reducing scrap, increasing wall strength, and increasing the number of shelf locations, while not increasing the number of parts for supporting the shelf 54.

Figure 17:
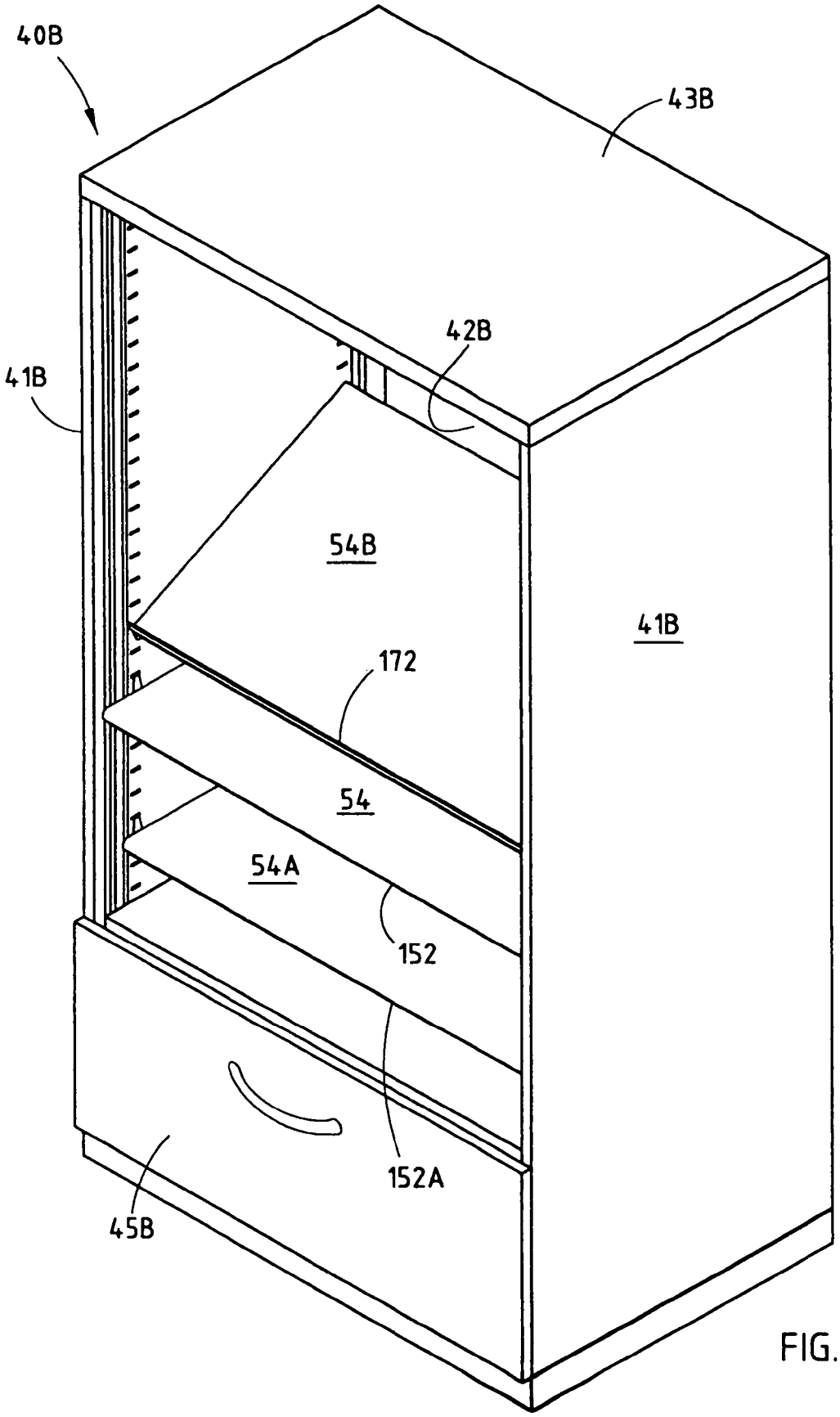
FIG. 17 is a perspective view of a tall cabinet, including a bottom drawer and open top shelves.
Figure 23:
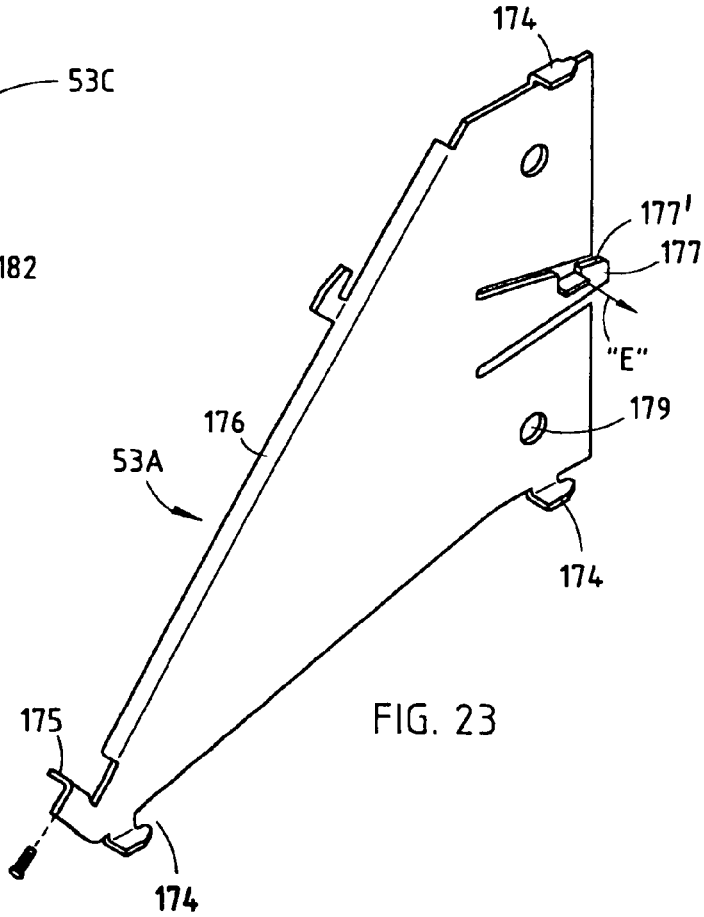

A modified bracket 53A (FIG. 23) is used to support the angled shelf 54B (FIG. 17). The shelf 54B is identical to the shelf 54, but the shelf 54B is held in an angled position and further is reversed front-to-rear to position the up flange or lip 172 at a front location to hold papers on the shelf and prevent items from sliding off of the shelf 54B. The modified bracket 53A (FIG. 23) includes a single front hook 174 and a pair of rear hooks 174 for engaging selected front and rear slots 55 on the cabinet sidewalls 41. A front tab 175 is positioned to abut a front of the shelf 54B to support a weight of the shelf 54B, and a flange 176 extends along a top edge of the bracket 54B also for supporting a weight of the shelf 54B. Screw holes can be provided in one or both of the tab 175 and flange 176 for receiving a screw to more firmly hold the shelf 54B, if desired. A resilient finger 177 extends rearwardly from the bracket 53A, and includes an interlock tab 177' for engaging a slot 55. The finger 177 is flexible along direction "E", but has a vertically elongated profile making it stiff in a vertical direction. By this arrangement, the finger 177 can be flexed inwardly to allow attachment of hooks 173 and 174 to selected slots 55, but can be flexed outwardly into an interlocking position that prevents release of the hooks 173 and 174 from the slots. A screw can also be threaded through hole 179 into the side panel 41B to secure the angle bracket 53A to the side panel of the cabinet, if desired.

Figure 21:
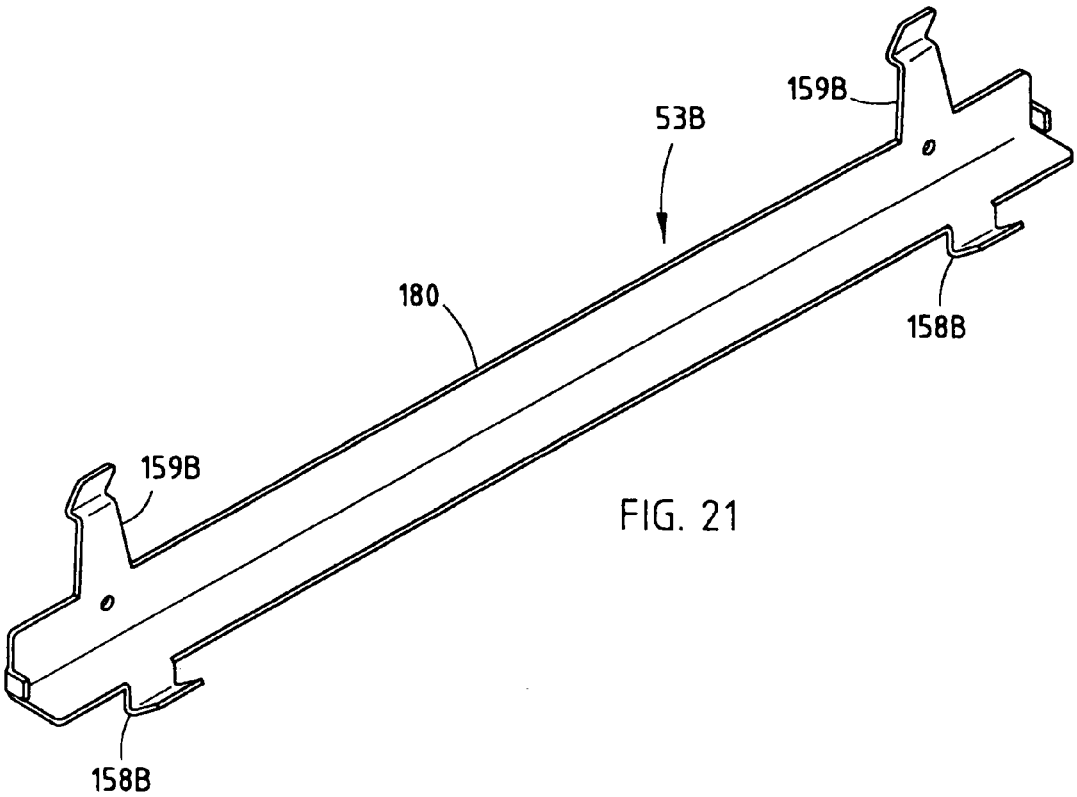
FIGS. 21-23 are perspective views of modified shelf brackets, the bracket of FIG. 21 being useful for supporting a translucent or transparent shelf in the cabinet (see FIG. 24), the bracket of FIG. 22 being useful for supporting a wood or particle shelf or a small trough shelf (see FIG. 27), and the bracket of FIG. 23 being useful for supporting a shelf at an angle (see FIG. 17)
Figure 24:
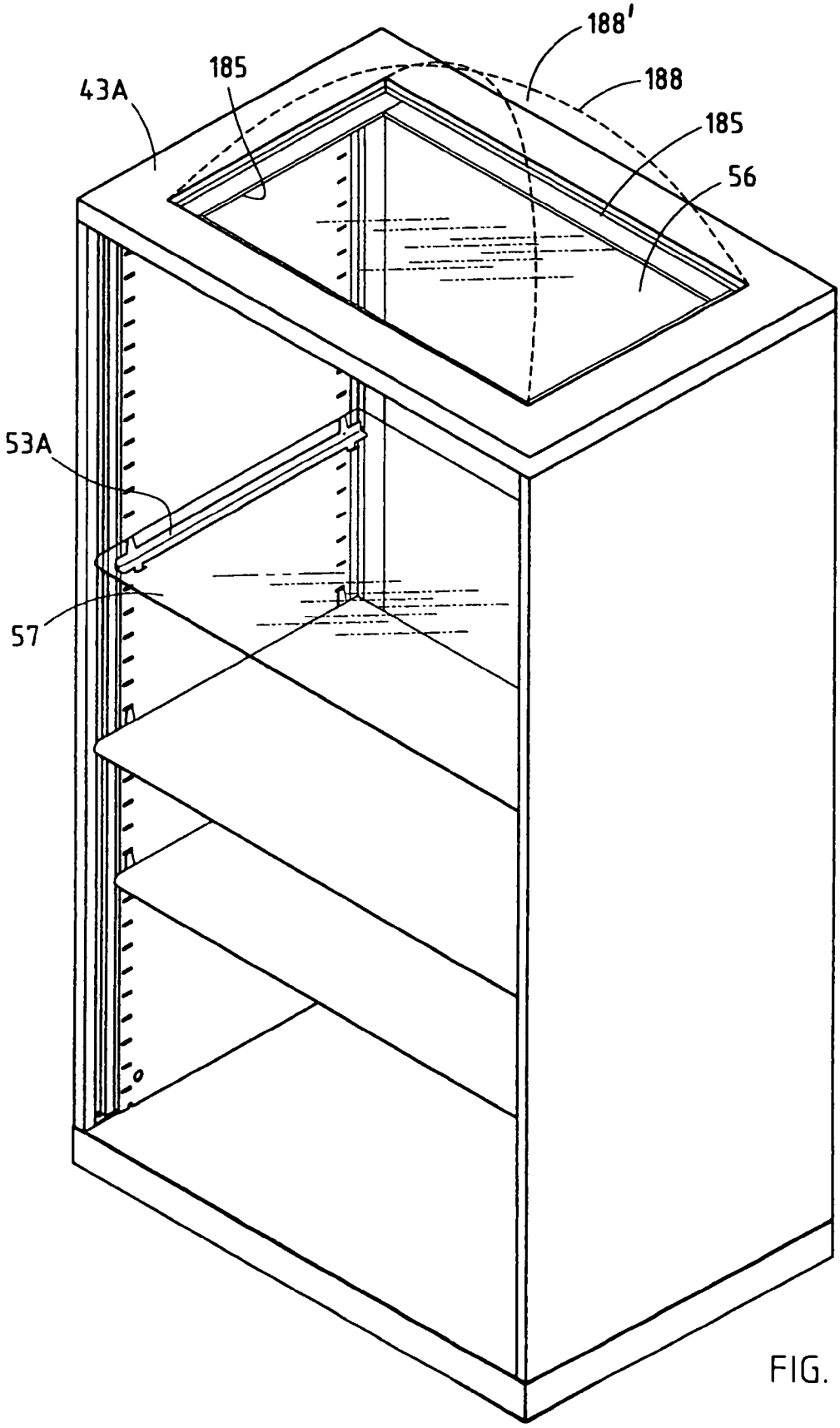
FIG. 24 is a perspective view of a modified cabinet similar to the cabinet of FIG. 17, but including a top panel supporting a transparent or translucent window panel, and including a transparent or translucent top shelf; with the dashed lines showing an alternative top panel having a tent-like translucent top sheet supported on a bent-wire frame.

It is contemplated that a variety of different brackets can be used to support shelves in the various cabinets that can be assembled from the above parts. For example, the bracket 53B (FIG. 21) includes a pair of short legs 158B and long legs 159B adapted to engage front and rear slots 55, and a connecting beam 180 having an L-shaped profile. The legs 158B and 159B allow the bracket 53B to be inverted, just like the bracket 53. The L-shaped profile of beam 180 also allows the bracket 53B to be inverted, with the L-shaped profile in both positions providing an under flange for supporting the weight of a panel shelf 181 and a side flange for laterally supporting the panel shelf 181. FIG. 24 shows a panel shelf 181 supported by the bracket 53B. The illustrated panel shelf 181 is transparent (or can be translucent). This is advantageous since, when used with a light-transmitting top, light is transmitted downwardly into the cabinet for improved visibility.

Figure 22:
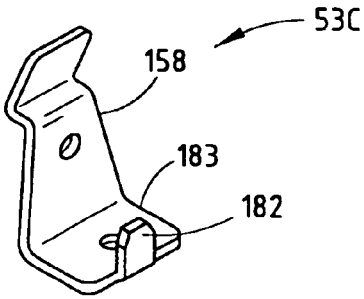

An additional bracket 53C (FIG. 22) can be used where adjustable shelving is not desired, and where it is desirable to firmly attach a panel shelf to a cabinet. The bracket 53C includes a short leg 158 with a hooked end for engaging a slot 55, and further includes an inwardly extending end 183. The bracket gusset 161 is eliminated, so that the panel shelf 181 does not require a mating notch along its edge. However, an up tab 182 is provided for engaging a hole in the panel shelf 181. Notably, in brittle materials, a vertical hole spaced from the shelf's side edge may be preferable to a notch along an edge of the shelf. Further, tab 182 can be vertically elongated or a screw can be used to provide a more positive retention of the shelf, if desired. Further, the tab 182 can be made long enough to be bent over on top of the shelf for secure attachment. Brackets 53C are illustrated as being used to support the door shelf 202 in FIG. 27.

Figure 8B:
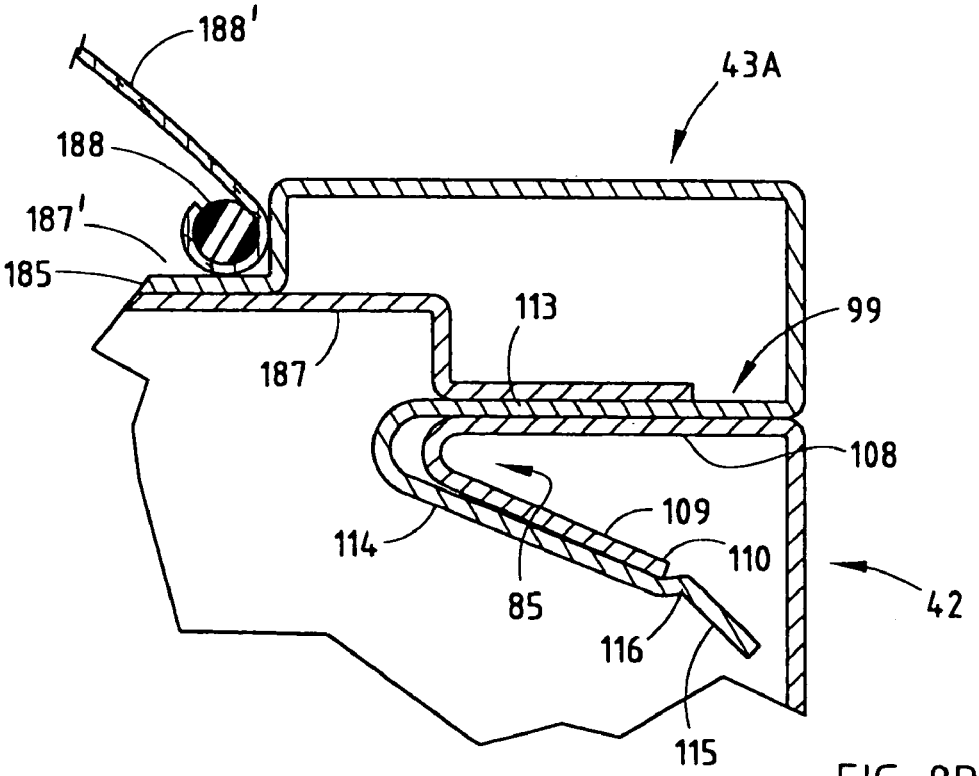
FIGS. 8A and 8B are cross sections similar to FIG. 8, but modified to have a recess and opening for receiving light transmitting inserts.
Figure 8A:
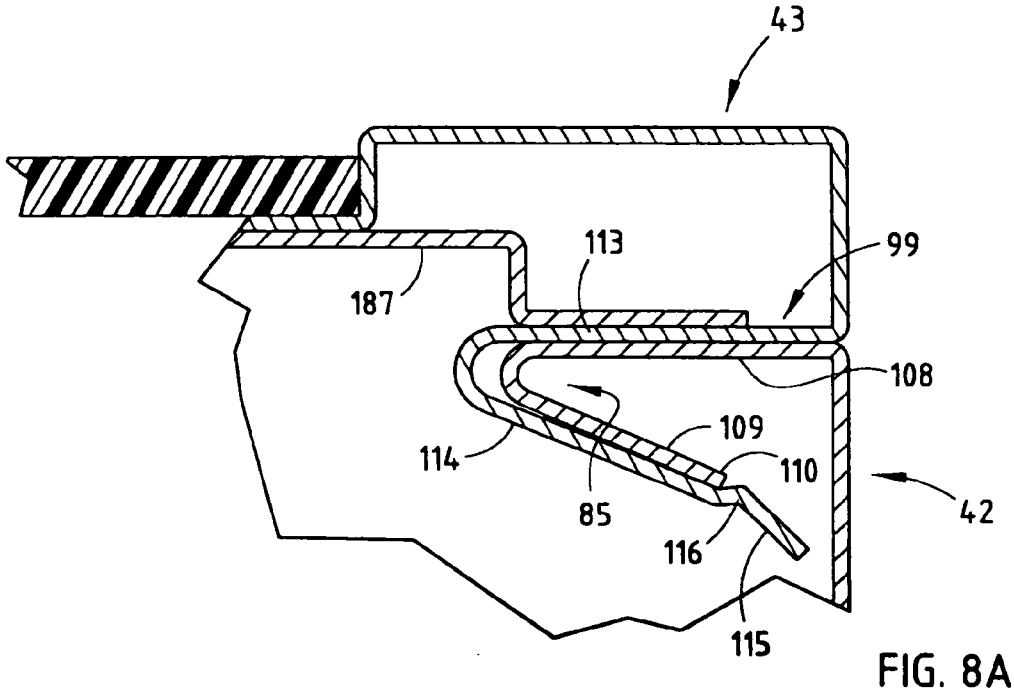

When added internal light is desired, the top panel 43A (FIG. 24) may be modified to include flanges 185 forming an opening and a recess for receiving a transparent (or translucent) panel 56. As illustrated in FIG. 24, the flanges 185 are spaced below an outer top surface of the top panel 43A, and are formed by an inner sheet of the top panel 43A or by Z-channels adhered to an underside of the outer sheet of the top panel 43A (see FIG. 8A). The top of the panel 43A (FIG. 24) is located generally flush with a top surface of the top panel 43A, thus maintaining the flatness of the top. However, a flat top may not be preferable, since things may be placed on the flat top. In one alternative, a wire frame 188 (shown in dashed lines in FIG. 24, but also see FIG. 8B) is placed inside the recess 187' formed by flanges 185, and a translucent material 188' is wrapped over the wire frame 188 to form a tent-like structure that is non-flat and that passes light downwardly into the cabinet.

Figure 25:
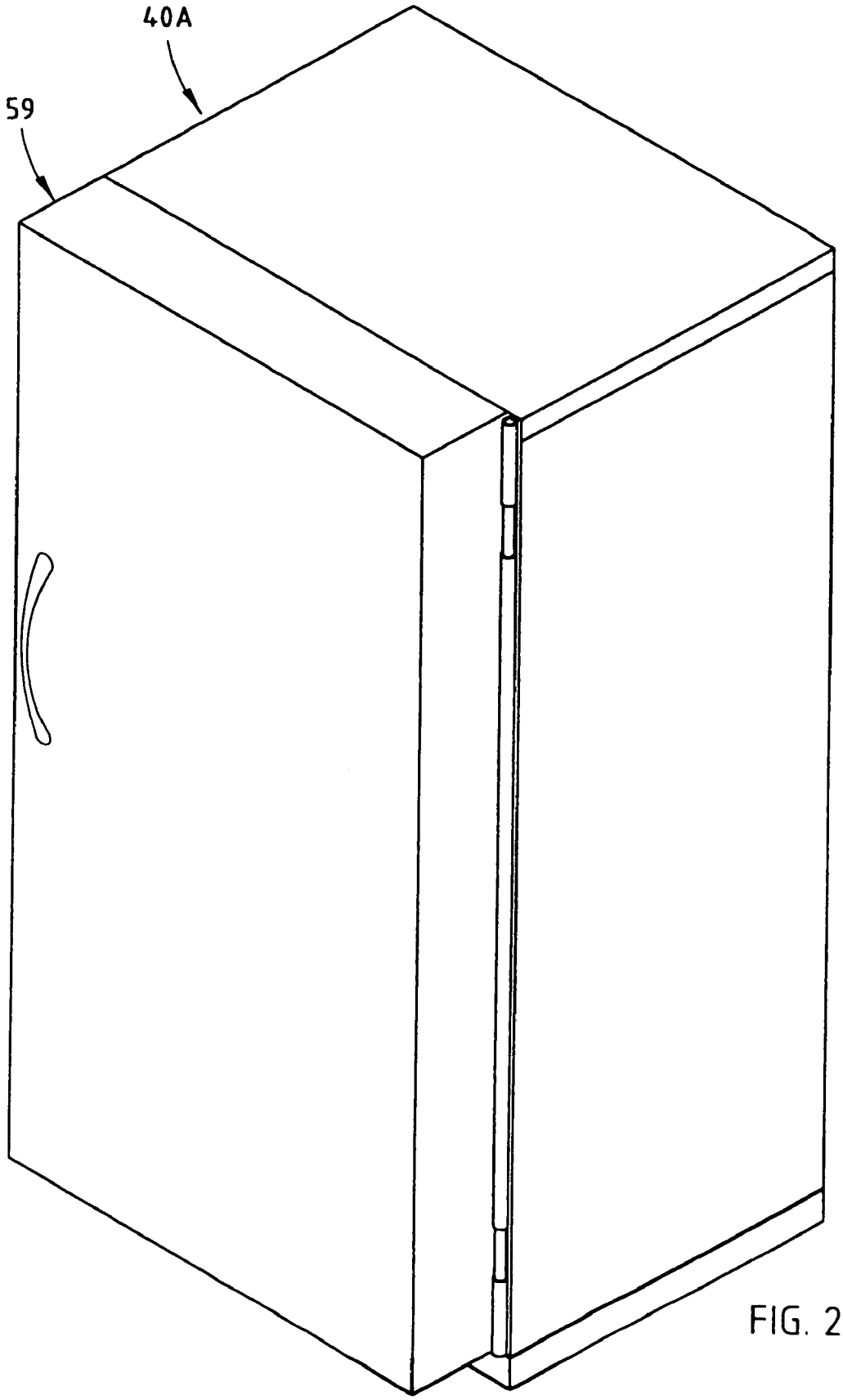
FIG. 25 is a perspective view of a second modified cabinet, similar to the cabinet of FIG. 17, but including a thick "storage" door.
Figure 26:
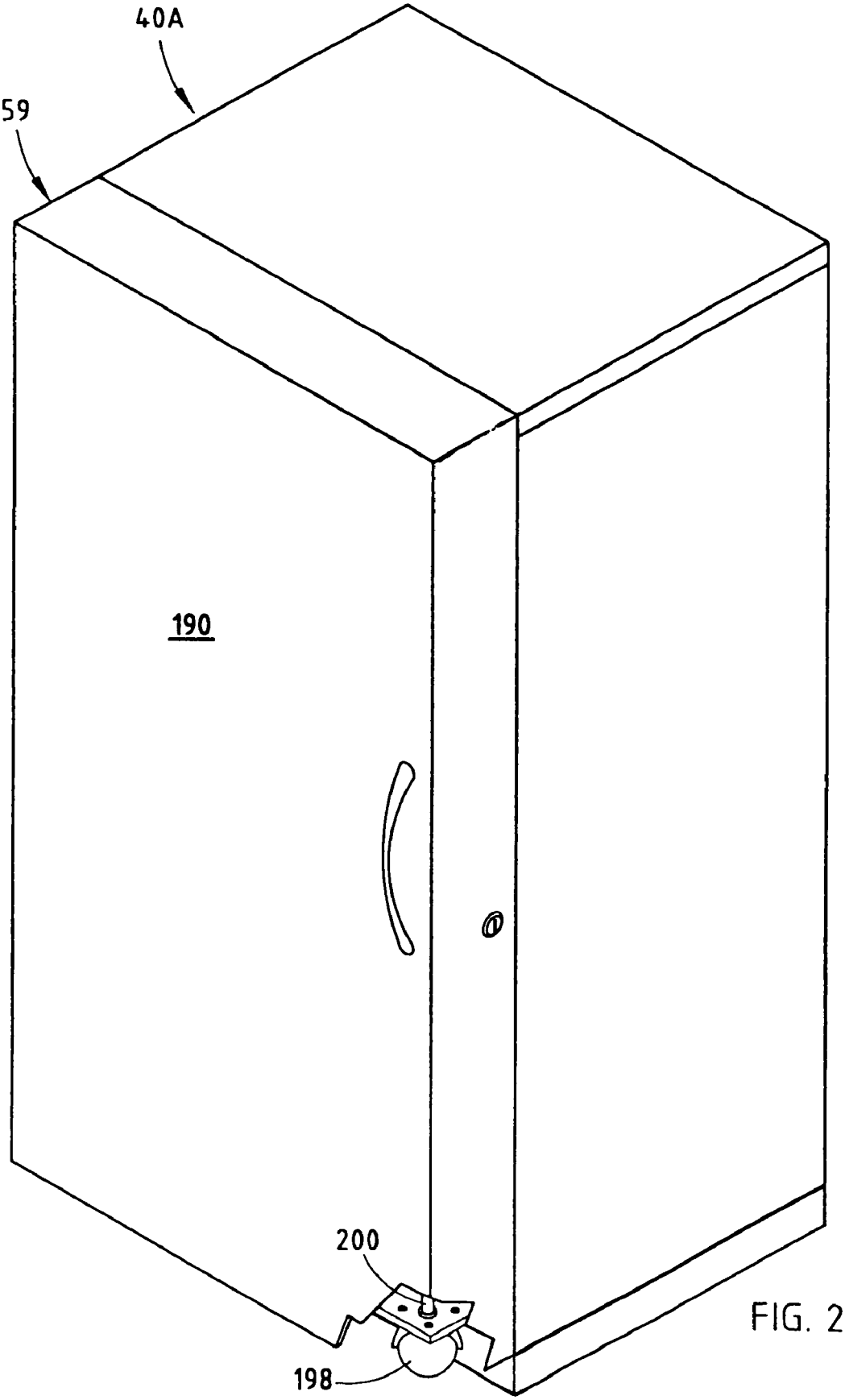
FIG. 26 is a perspective view of a cabinet similar to the cabinet of FIG. 25, including a door hinge on an opposite side, and including a lock, and a floor castor, a corner of the door being partially broken away to expose the floor castor.

Various doors can be attached to the cabinet 40A, including a storage door 59 (FIG. 25-27), a proud door 60 (FIG. 28-29) or an inset door 61 (FIG. 32). The storage door 59 (FIG. 27) is attached to a cabinet 40D, and includes a front panel 190 and top, side and bottom walls 191-194 defining a storage cavity within the door 59. A hinge 195 includes a first side 196 (FIG. 31) attached to the side panels 41, and a second side 193' attached to the door sidewall 193. The hinge first side 196 can be attached to either side of the cabinet 40D (compare FIGS. 25 and 26). Several different hinge arrangements are known in the industry for mounting doors, such that a detailed description of the hinge 195 is not required. Nonetheless, it is noted that the hinge first side 196 can include hooks for engaging slots 55 in the side panel 41 for added stability, and one or more screw-receiving tabs for securement. (See the hinge bracket 58 shown in FIG. 30 and the hinge arrangements of FIGS. 29, 30A-30C, as described below).

A roller or castor 198 (FIG. 26-27) is attached to a bottom of the door 59 at a location opposite the hinge 195, for supporting a weight of the door 59 as the door is opened. A structural box 199 is formed around the castor 198 for supporting a top pin 200 of the illustrated castor 198, permitting the castor 198 to orient itself. Nonetheless, it is contemplated that a castor oriented in a fixed angled direction would also work well for supporting the door 59. The castor 198 can be made vertically adjustable and vertically spring-biased to better compensate for uneven floors, if desired.

Shelves 202 and 203 (FIG. 27) are supported on side walls 192-193 within the door 59. The shelf 202 includes a horizontal channel with a bottom 204 and front and rear side flanges 205 and 206 that both stiffen the shelf 202 and retain items on the shelf 202. Tabs (not specifically shown) extend longitudinally from ends of the channel and engage the front and rear slots 207 in the door side walls 192-193, thus holding the shelf 202 at a selected vertical height. A resilient band 209 is flexed inwardly and positioned in the shelf 202 between the side flanges 205 and 206 at selected locations, for dividing the shelf 202 into manageable spaces. By compressing the bands 209, they can be released and relocated. The bottom shelf 203 forms a vertically-open pocket with side walls 210 and a front wall 211. A pivot bracket 212 engages a selected lower slot 207 and includes a U-shaped up flange 213 that pivotally supports a pivot pin 214 on the shelf side wall. A top bracket 215 includes a protrusion that engages another selected slot 207 and acts as a forward and rearward stop by engaging ends of an arcuate slot 216 in the sidewall 210 of the shelf 202. In the forwardly tiled position of the pocket shelf 203, a top 217 of the shelf 203 is open for receiving papers and articles placed therein. In the closed position, the top 217 of the shelf 203 is covered by the channel shelf 202 when the shelf 202 is located immediately above it.

It is contemplated that a variety of other storage devices can be positioned within the door 59. For example, a bent wire 218 is shown with ends that engage the slots 207. The bent wire is positioned above the shelf 202, and helps retain tall items placed on the channel shelf 202, such as rolled drawings 209 and the like. The bent wire 218 has vertical portions that are tall enough and a horizontal portion wide enough, such that they provide enough flexibility for the bent wire to flex and slightly bend when receiving the drawings 209. Alternatively, the bent wire can be made to be fixed or made to swing in the slots 207.

The storage door 59 creates additional storage space within the cabinet 40A, such that a magnetic-base coat hook 219 or magnetic base whiteboard or notepad 220 can be attached to the door 59. However, the storage space within the door 59 does not intrude into the cabinet 40A, but instead is fully contained within the confines of the door 59. Because of this, the shelves 54 within the cabinet 40A do not need to be made shorter and their front edges do not need to be recessed within the cabinet. Therefore, the shelves 54 remain at a "full" depth of the cabinet. Also, the storage capacity in the door 59 adds to the overall storage capacity of the cabinet, and does not detract from it or "infringe" upon it. It is noted that storage on the door 59 can be made to intrude into the cabinet 40A when the door 59 is closed if the user desires this arrangement, and it is further noted that the present arrangement facilitates such an arrangement since the shelf 54 can be positioned in an inset condition, if desired. Nonetheless, the present illustrated storage devices 202, 203, and 218 are believed to be very desirable since the door 59 adds to the storage space of the cabinet 40A and does not merely "steal" cavity space from the cabinet.

Figure 30C:
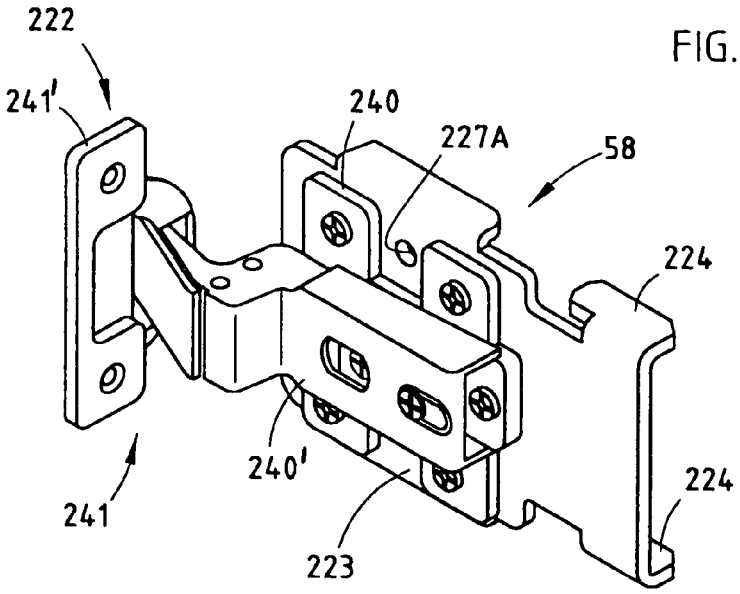
Figure 31:
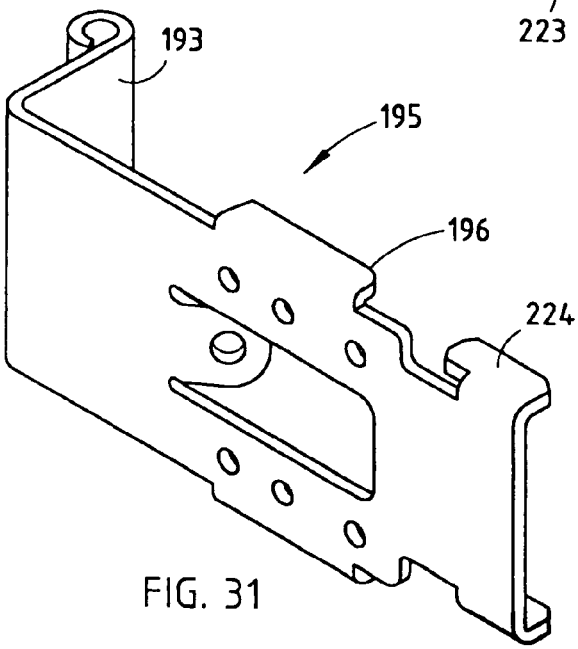
FIG. 31 is a perspective view showing a heavy-duty hinge for supporting a storage door (see FIGS. 25-27)

A hinge bracket 58 (FIG. 30) is provided for use with a proud hinge 221 for supporting a proud door 60 (FIGS. 28-29, 30A and 30B) and is provided for use with an inset hinge 222 for supporting an inset door 61 (FIGS. 30C and 32). The hinge bracket 58 (FIG. 30) includes a body plate 223 with a pair of forwardly-facing hooks 224 shaped to selectively engage a pair of front cabinet slots 55. An angled tab 225 includes a screw hole 226 for receiving a screw extended through the hole 226 into a mating angled flange 227 (FIG. 4) on the inner sheet of the cabinet side panel 41. When installed, the screw locks the hooks 224 in the slots 55. Four or more holes 227A (FIG. 30) are provided in the body plate 223. The proud hinge 221 (FIG. 30A) includes a stationary half 229 with apertured attachment flanges 230 having holes that align with some of the holes 227A. Screws are extended through the apertured attachment flanges 230 and threaded into the holes 227A for retaining the proud hinge 221 to the hinge bracket 58. A movable half 231 is operably pivotally mounted to the stationary half 229 by a four-bar-linkage arrangement. The movable half 231 includes an arm 230' with an outer flange 231' adapted to be attached to the door 60, such as with screws or other means. The four-bar-linkage arrangement is not specifically illustrated, but such hinges are well known in the art, such that a detailed description of the four-bar-linkage and hinge arrangement is not required for an understanding by those skilled in this art. For example, see McWhirt et al. U.S. Pat. No. 5,930,883. The door 60 is shaped to cover the front of the cabinet 40A (FIG. 28), including a front surface of the side, top, and bottom panels 41, 42, and 44.

The inset hinge 222 (FIG. 30C) includes a stationary half 239 with apertured attachment flanges 240 having holes that align with the holes 237A. Screws are extended through the apertured attachment flanges 240 and threadably into the holes 237A for retaining the inset hinge 222 to the hinge bracket 58. A movable half 241 is operably pivotally mounted to the stationary half 239 by a four-bar-linkage arrangement. The movable half 241 includes an arm 240' with an outer flange 241' adapted to be attached to the door 61, such as with screws or other means. The four-bar-linkage arrangement of this hinge is also not specifically illustrated, but such hinges are well known in the art, such that a detailed description is not required. The four-bar-linkage arrangement of the inset hinge 222 is similar to the four-bar-linkage arrangement of the proud hinge 221, but the four-bar-linkage is changed to locate the door 61 in an inset position within the front opening defined by the cabinet 40D (FIG. 32). Consistent with this, the door 61 includes an outer perimeter shaped to fit inside the cabinet front opening. Also, any shelves 54 or drawers 45 (FIG. 29) are positioned in a recessed or inset position to make room for the door 61. When door 61 is opened, the inset hinge 222 first moves the door 61 quickly outwardly to clear the front edges of the side panels 41, and then the door 61 swings to an open position.

Figure 34:
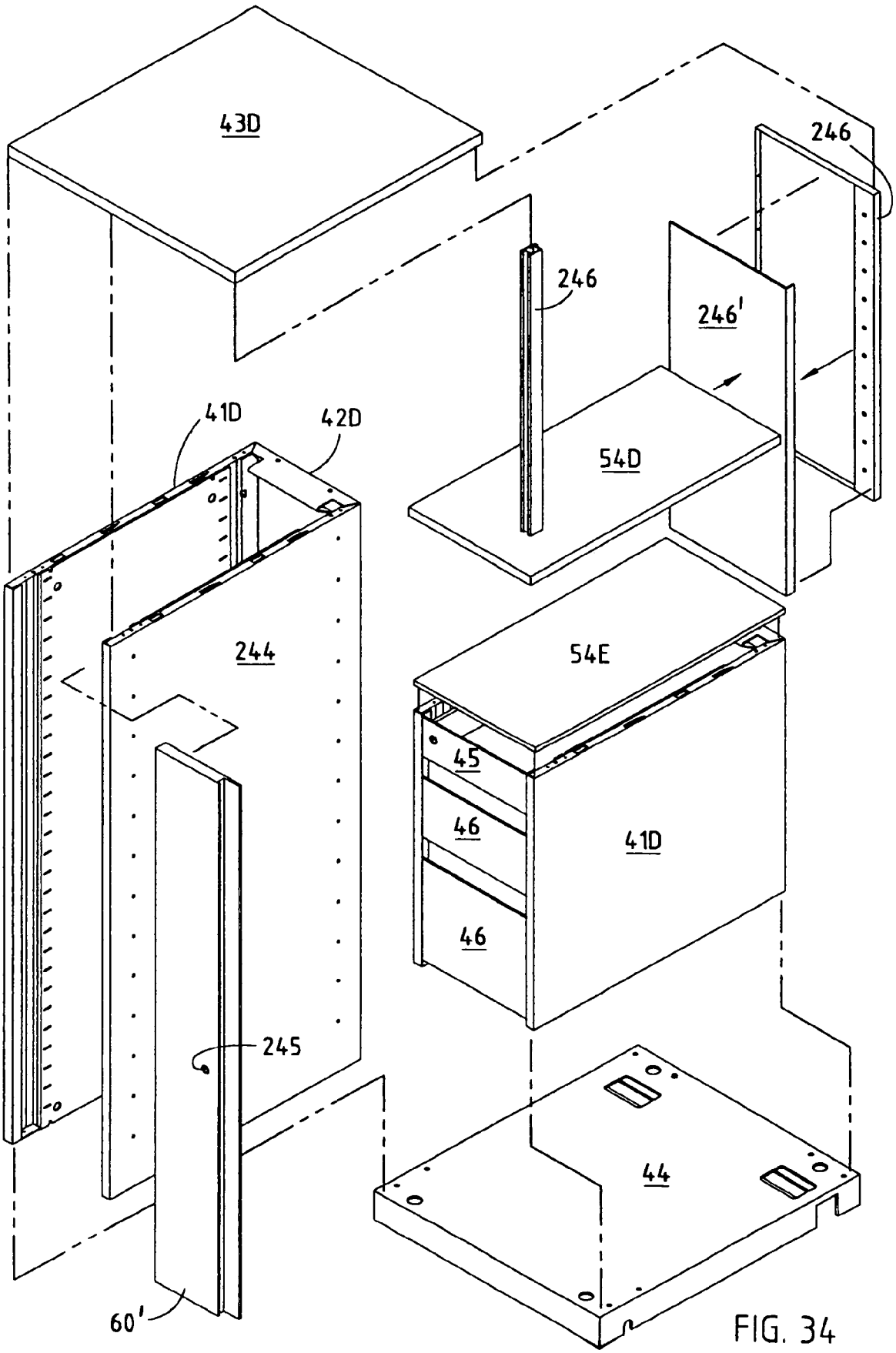
FIG. 34 is an exploded view of the cabinet of FIG. 33.

Cabinet 40D (FIGS. 33 and 34) exemplifies the wide number of variations possible using various concepts and features noted above. Cabinet 40D is a tall cabinet having side, top, back, and bottom panels 41D-44D that are identical to or similar to the same panels 41-44 in cabinet 40. However, an intermediate vertical panel 244 (which is similar to side panel 41 in many aspects) has been added to divide the cabinet 40D into right and left halves. The vertical panel 244 extends between the top and bottom panels 43D and 44D and includes apertured attachment flanges (not specifically shown) or the like for screw attachment to the inner sheets of the top and bottom panels 43D and 44D. The illustrated door is a lockable inset door 61D, and includes a door lock 245. This makes the left portion useful as a coat closet, or usable to store tall items, such as rolled drawings, brooms and the like.

The right side of the cabinet 40D includes a lower half with three drawers 45D, 46D, and 46D, and an upper half with two open shelves 54D and a bottom shelf 54E. The bottom shelf 54E includes a flat top surface 250, and is similar to a top panel 43. An outer side edge 251 includes a flange (like flange 96 in FIG. 2) shaped for mating snap attachment to a top of the side panel 41D. An inner side edge 252 includes a flange shaped for screw attachment and/or adhesive attachment to the intermediate vertical panel 244. A rear edge 253 includes a flange shaped for screw and/or adhesive attachment to the back panel 42D, which includes outer panel 246 and inner stiffener 236'. A beam 246 extends upwardly from the front/outer corner of shelf 54E at the front edge of the side panel 41D. The beams 246 include a lower end with attachment flanges for screw attachment to the bottom shelf 54E and an upper end with attachment flanges for screw attachment to the top panel 43D. The drawers 45D, 46D and 46D include headers that are recessed into the front opening of the cabinet 40D. The drawer 45D includes a locking arrangement similar to the locking arrangement shown in drawer 45 with header 48 discussed above.

The present cabinet 40D includes a single top 43D and a single bottom 44D. However, it is contemplated that the cabinet 40D can also be made by positioning two independent (right and left) cabinets adjacent each other, with adjacent abutting side panels of the right and left cabinets being secured together by screws or adhesive or other means. In such event, the top panels can be separate panels that abut. Alternatively, as illustrated, a single top panel can be used that includes a single outer sheet and a pair of adjacent inner sheets that simulate the connecting structure necessary for snap attachment to the top of the side panels on each of the right and left cabinets.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A cabinet comprising:

side panels including inner surfaces defining an enclosure, the inner surfaces each including vertical rows of apertures defining a unitary vertical spacing;

a shelf; and a plurality of brackets shaped to selectively engage the apertures to support the shelf on the side panels, the brackets including a first leg having a first end and a second leg having a second end, the first end being shaped to engage a selected one of the apertures with the second leg positioned to support the shelf at a first height, and the second end being shaped to engage the selected one of the apertures with the first leg positioned to support the shelf at a second height different than the first height, whereby the shelf can be selectively supported at different heights from the same selected apertures while using the same brackets.

2. The cabinet defined in claim 1, wherein the first and second ends of the brackets are identical, and wherein the second length of the second leg is greater than the first length of the first leg.

3. The cabinet defined in claim 1, wherein the first and second ends of the brackets are identical.

4. A cabinet comprising:

side panels including inner surfaces defining an enclosure, the inner surfaces each including vertical rows of apertures defining a unitary vertical spacing;

a shelf; and a plurality of brackets shaped to selectively engage the apertures to support the shelf on the side panels, the brackets including a first leg having a first end and a first length, and a second leg having a second end and a second length that is greater than the first length, the first end being shaped to engage a selected one of the apertures with the second leg positioned to support the shelf at a first height, and the second end being shaped to engage the selected one of the apertures with the first leg positioned to support the shelf at a second height different than the first height, whereby the shelf can be selectively supported at different heights from the same selected apertures while using the same brackets.

5. A cabinet comprising:

side panels including inner surfaces defining an enclosure, the inner surfaces each including vertical rows of apertures defining a unitary vertical spacing;

a shelf; and a plurality of brackets shaped to selectively engage the apertures to support the shelf on the side panels, the brackets including a first leg having a first end and a first length, and a second leg having a second end and a second length, the first and second legs sharing a common corner positioned therebetween, the first end being shaped to engage a selected one of the apertures with the second leg positioned to support the shelf at a first height, and the second end being shaped to engage the selected one of the apertures with the first leg positioned to support the shelf at a second height different than the first height, whereby the shelf can be selectively supported at different heights from the same selected apertures while using the same brackets.

6. The cabinet defined in claim 5, wherein the first and second ends of the brackets are identical.

7. The cabinet defined in claim 5, wherein the second length of the second leg is greater than the first length of the first leg.

* * * * *